US011170688B2

(12) United States Patent
Kim et al.

(10) Patent No.: US 11,170,688 B2
(45) Date of Patent: Nov. 9, 2021

(54) METHOD OF DRIVING A DISPLAY PANEL AND DISPLAY DEVICE EMPLOYING THE SAME

(71) Applicant: Samsung Display Co., Ltd., Yongin-Si (KR)

(72) Inventors: Hongsoo Kim, Hwaseong-si (KR); Sehyuk Park, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/027,798

(22) Filed: Jul. 5, 2018

(65) Prior Publication Data

US 2019/0172381 A1 Jun. 6, 2019

(30) Foreign Application Priority Data

Dec. 5, 2017 (KR) ..... 10-2017-0165693

(51) Int. Cl.
*G09G 3/20* (2006.01)
*G09G 3/34* (2006.01)
(Continued)

(52) U.S. Cl.
CPC ..... *G09G 3/2003* (2013.01); *G09G 3/2096* (2013.01); *G09G 3/3208* (2013.01); *G09G 3/3233* (2013.01); *G09G 3/344* (2013.01); *G09G 2300/0842* (2013.01); *G09G 2310/0235* (2013.01); *G09G 2310/0251* (2013.01);
(Continued)

(58) Field of Classification Search
CPC .. G09G 3/2003; G09G 3/2096; G09G 3/3208; G09G 3/344; G09G 3/3233; G09G 2300/0842; G09G 2310/0235; G09G 2310/0251; G09G 2310/0262;
(Continued)

(56) References Cited

U.S. PATENT DOCUMENTS

2005/0030268 A1* 2/2005 Zhang ..... G09G 3/3208 345/83
2009/0046051 A1* 2/2009 Choi ..... G02F 1/167 345/107
(Continued)

FOREIGN PATENT DOCUMENTS

KR 100862666 B1 10/2008
KR 1020120056246 A 6/2012
(Continued)

*Primary Examiner* — Stephen G Sherman
(74) *Attorney, Agent, or Firm* — Kile Park Reed & Houtteman PLLC

(57) ABSTRACT

A method of driving a display panel including a plurality of pixels, each of which outputs different color lights corresponding to voltage ranges to which a driving voltage applied thereto belongs, includes dividing one image frame into first through third sub-frames, outputting a first color image displayed by a first color by applying a first driving voltage belonging to a first voltage range to the pixels in the first sub-frame, outputting a second color image displayed by a second color by applying a second driving voltage belonging to a second voltage range to the pixels in the second sub-frame, and outputting a third color image displayed by a third color by applying a third driving voltage belonging to a third voltage range to the pixels in the third sub-frame.

27 Claims, 18 Drawing Sheets

(51) Int. Cl.
*G09G 3/3208* (2016.01)
*G09G 3/3233* (2016.01)

(52) U.S. Cl.
CPC ..... *G09G 2310/0262* (2013.01); *G09G 2310/061* (2013.01); *G09G 2320/0242* (2013.01); *G09G 2320/0266* (2013.01); *G09G 2340/0435* (2013.01)

(58) Field of Classification Search
CPC ..... G09G 2310/061; G09G 2320/0242; G09G 2320/0266
USPC ..... 345/691
See application file for complete search history.

(56) References Cited

U.S. PATENT DOCUMENTS

2015/0317952 A1* 11/2015 Ohara ..... G09G 3/3233 345/213
2018/0267360 A1* 9/2018 Hsiao ..... G02F 1/133603

FOREIGN PATENT DOCUMENTS

KR 1020150078261 A 7/2015
KR 101718382 B1 3/2017

* cited by examiner

METHOD OF DRIVING A DISPLAY PANEL AND DISPLAY DEVICE EMPLOYING THE SAME

This application claims priority to Korean Patent Application No. 10-2017-0165693, filed on Dec. 5, 2017, and all the benefits accruing therefrom under 35 U.S.C. § 119, the content of which in its entirety is herein incorporated by reference.

BACKGROUND

1. Field

Exemplary embodiments relate generally to a display device. More particularly, embodiments of the invention relate to a method of driving a display panel that includes a plurality of pixels, each including an organic light emitting element, and a display device that employs the method of driving the display panel.

2. Description of the Related Art

Generally, a display panel includes a plurality of pixels and displays an image based on colors that the pixels implement. Recently, materials for an organic light emitting element to allow one pixel to implement two or more colors using dielectrophoresis and/or electrophoresis have been developed. Such an organic light emitting element included in the pixel may have a structure in which different dielectric particles (e.g., dielectric particles having different dielectric constants) colored in different colors exist in a dielectric medium. In such an organic light emitting element, the dielectric particles may move differently in the dielectric medium when an electric field is formed in the structure as a driving voltage is applied to the pixel. That is, since a force applied to the dielectric particle is determined by a difference between a dielectric constant of the dielectric particle and a dielectric constant of the dielectric medium, the forces applied to the dielectric particles may be different because the dielectric constants of the dielectric particles are different. In addition, different electric fields may be generated in the structure when different driving voltages are applied to the pixel. Thus, one pixel including the organic light emitting element may output different color lights corresponding to voltage ranges to which the driving voltage applied to the pixel belongs.

SUMMARY

In a display device including an organic light emitting element having a structure in which different dielectric particles colored in different colors exist in a dielectric medium, a pixel may output a first color light (e.g., a red color light) when the driving voltage applied to the pixel belongs to a first voltage range, may output a second color light (e.g., a green color light) when the driving voltage applied to the pixel belongs to a second voltage range, and may output a third color light (e.g., a blue color light) when the driving voltage applied to the pixel belongs to a third voltage range. Therefore, a technique for efficiently driving a display panel that includes a plurality of pixels of which each outputs different color lights according to voltage ranges, to which a driving voltage applied to the pixel belongs, is desired.

Exemplary embodiments relate to a method of driving a display panel to efficiently drive a display panel including a plurality of pixels, each of which outputs different color lights corresponding to voltage ranges to which a driving voltage applied to the pixel belongs.

Exemplary embodiments relate to a display device that employs the method of driving the display panel.

According to an exemplary embodiment, a method of driving a display panel that includes a plurality of pixels, each of which outputs different color lights corresponding to voltage ranges to which a driving voltage applied to the pixel belongs, includes dividing one image frame into first through third sub-frames, outputting a first color image displayed by a first color by applying a first driving voltage belonging to a first voltage range to the pixels in the first sub-frame, outputting a second color image displayed by a second color by applying a second driving voltage belonging to a second voltage range to the pixels in the second sub-frame, and outputting a third color image displayed by a third color by applying a third driving voltage belonging to a third voltage range to the pixels in the third sub-frame.

In an exemplary embodiment, each of the pixels may include an organic light emitting element including dielectrophoresis materials.

In an exemplary embodiment, the first color image may be a red color image, the second color image may be a green color image, and the third color image may be a blue color image.

In an exemplary embodiment, the method may further include outputting a black color image by applying a fourth driving voltage to the pixels between the first sub-frame and the second sub-frame, outputting the black color image by applying the fourth driving voltage to the pixels between the second sub-frame and the third sub-frame, and outputting the black color image by applying the fourth driving voltage to the pixels between the third sub-frame and a next image frame.

In an exemplary embodiment, the first voltage range may be lower than the second voltage range, the second voltage range may be lower than the third voltage range, and the third voltage range may be lower than the fourth driving voltage.

According to another exemplary embodiment, a method of driving a display panel including a plurality of pixels, each outputs different color lights corresponding to voltage ranges to which a driving voltage applied to the pixel belongs, includes dividing one image frame into first through fourth sub-frames, outputting a first color image displayed by a first color by applying a first driving voltage belonging to a first voltage range to the pixels in the first sub-frame, outputting a second color image displayed by a second color by applying a second driving voltage belonging to a second voltage range to the pixels in the second sub-frame, outputting a third color image displayed by a third color by applying a third driving voltage belonging to a third voltage range to the pixels in the third sub-frame, and outputting a fourth color image displayed by a fourth color by applying a fourth driving voltage belonging to a fourth voltage range to the pixels in the fourth sub-frame.

In an exemplary embodiment, each of the pixels may include an organic light emitting element including dielectrophoresis materials.

In an exemplary embodiment, the first color image may be a white color image, the second color image may be a red color image, the third color image may be a green color image, and the fourth color image may be a blue color image.

In an exemplary embodiment, the method may further include outputting a black color image by applying a fifth driving voltage to the pixels between the first sub-frame and the second sub-frame, outputting the black color image by applying the fifth driving voltage to the pixels between the second sub-frame and the third sub-frame, outputting the black color image by applying the fifth driving voltage to the pixels between the third sub-frame and the fourth sub-frame, and outputting the black color image by applying the fifth driving voltage to the pixels between the fourth sub-frame and a next image frame.

In an exemplary embodiment, the first voltage range may be lower than the second voltage range, the second voltage range may be lower than the third voltage range, the third voltage range may be lower than the fourth voltage range, and the fourth voltage range is lower than the fifth driving voltage.

According to an exemplary embodiment, a display device may include a display panel including a plurality of pixels of which each outputs first through k-th color lights, where k is an integer greater than or equal to 2, in response to first through k-th driving voltages, respectively, the first through k-th driving voltages belonging to first through k-th voltage ranges, respectively, and a display panel driving circuit which drives the display panel in a field sequential driving technique by dividing one image frame into first through k-th sub-frames and by applying the first through k-th driving voltages to the pixels in the first through k-th sub-frames, respectively.

In an exemplary embodiment, each of the pixels may include an organic light emitting element including dielectrophoresis materials.

In an exemplary embodiment, each of the pixels may output a red color light when the first driving voltage belonging to the first voltage range is applied thereto, may output a green color light when the second driving voltage belonging to the second voltage range is applied thereto, and may output a blue color light when the third driving voltage belonging to the third voltage range is applied thereto.

In an exemplary embodiment, the display panel driving circuit may divide the image frame into the first through third sub-frames, may output a red color image by applying the first driving voltage to the pixels in the first sub-frame, may output a green color image by applying the second driving voltage to the pixels in the second sub-frame, and may output a blue color image by applying the third driving voltage to the pixels in the third sub-frame.

In an exemplary embodiment, the display panel driving circuit may output a black color image by applying a fourth driving voltage to the pixels between the first sub-frame and the second sub-frame, may output the black color image by applying the fourth driving voltage to the pixels between the second sub-frame and the third sub-frame, and may output the black color image by applying the fourth driving voltage to the pixels between the third sub-frame and a next image frame.

In an exemplary embodiment, the display panel driving circuit may implement the image frame at a frequency of n Hz, where n is an integer greater than or equal to 2, by receiving image data corresponding to the image frame from an external component at the frequency of n Hz and by implementing each of the first through third sub-frames based on the image data at a frequency of 3×n Hz.

In an exemplary embodiment, the display panel driving circuit may implement the image frame at a frequency of n Hz, where n is an integer greater than or equal to 2, by receiving image data corresponding to each of the first through third sub-frames from an external component at a frequency of 3×n Hz and by implementing each of the first through third sub-frames based on the image data at the frequency of 3×n Hz.

In an exemplary embodiment, each of the pixels may output a white color light when the first driving voltage belonging to the first voltage range is applied thereto, may output a red color light when the second driving voltage belonging to the second voltage range is applied thereto, may output a green color light when the third driving voltage belonging to the third voltage range is applied thereto, and may output a blue color light when the fourth driving voltage belonging to the fourth voltage range is applied thereto.

In an exemplary embodiment, the display panel driving circuit may divide the image frame into the first through fourth sub-frames, may output a white color image by applying the first driving voltage to the pixels in the first sub-frame, may output a red color image by applying the second driving voltage to the pixels in the second sub-frame, may output a green color image by applying the third driving voltage to the pixels in the third sub-frame, and may output a blue color image by applying the fourth driving voltage to the pixels in the fourth sub-frame.

In an exemplary embodiment, the display panel driving circuit may output a black color image by applying a fifth driving voltage to the pixels between the first sub-frame and the second sub-frame, may output the black color image by applying the fifth driving voltage to the pixels between the second sub-frame and the third sub-frame, may output the black color image by applying the fifth driving voltage to the pixels between the third sub-frame and the fourth sub-frame, and may output the black color image by applying the fifth driving voltage to the pixels between the fourth sub-frame and a next image frame.

In an exemplary embodiment, the display panel driving circuit may implement the image frame at a frequency of n Hz, where n is an integer greater than or equal to 2, by receiving image data corresponding to the image frame from an external component at the frequency of n Hz and by implementing each of the first through fourth sub-frames based on the image data at a frequency of 4×n Hz.

In an exemplary embodiment, the display panel driving circuit may implement the image frame at a frequency of n Hz, where n is an integer greater than or equal to 2, by receiving image data corresponding to each of the first through fourth sub-frames from an external component at a frequency of 4×n Hz and by implementing each of the first through fourth sub-frames based on the image data at the frequency of 4×n Hz.

In exemplary embodiments, a method of driving a display panel may be used to drive a display panel including a plurality of pixels, each of which outputs first through k-th color lights, where k is an integer greater than or equal to 2, in response to first through k-th driving voltages, where the first through k-th driving voltages belong to first through k-th voltage ranges, respectively. In such embodiments, the method may efficiently be used to drive the display panel including the pixels, each of which outputs different color lights corresponding to voltage ranges to which a driving voltage applied to the pixel belongs by driving the display panel using a field sequential driving technique that divides one image frame into first through k-th sub-frames and applies the first through k-th driving voltages to the pixels in the first through k-th sub-frames, respectively.

In an exemplary embodiment, a display device that employs the method of driving the display panel may display an image with a high resolution as compared to a conventional display device.

BRIEF DESCRIPTION OF THE DRAWINGS

The above and other features of the invention will become more apparent by describing in further detail exemplary embodiments thereof with reference to the accompanying drawings, which.

DETAILED DESCRIPTION

Figure 1:
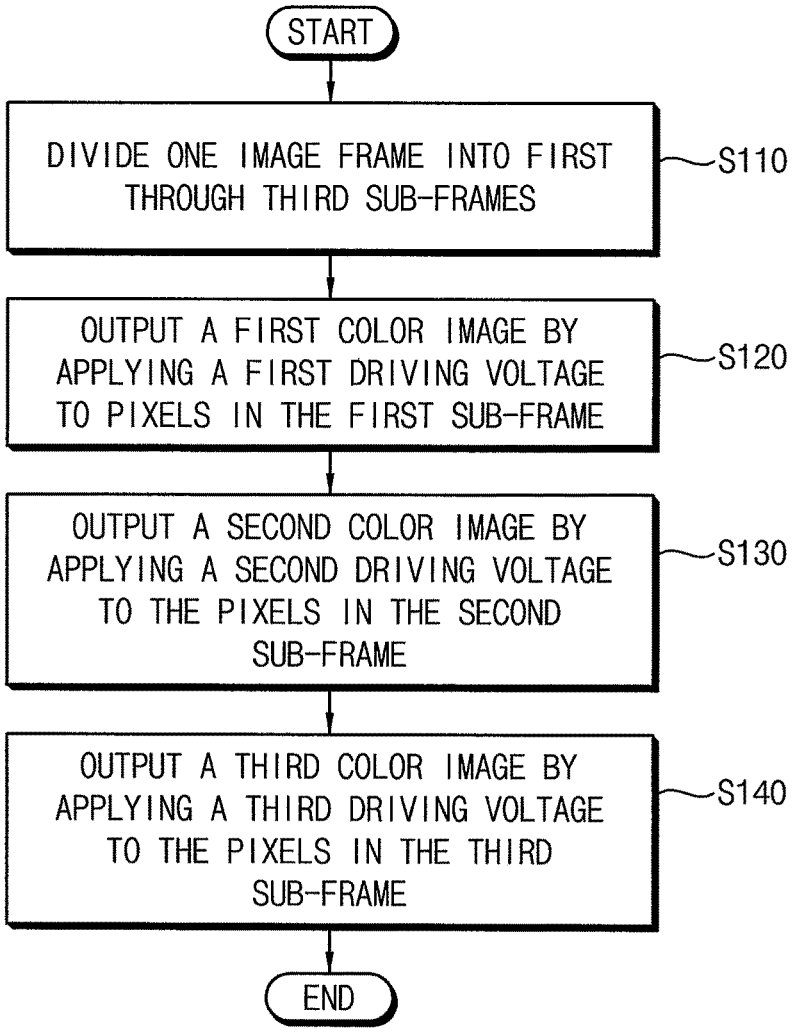
FIG. 1 is a flowchart illustrating a method of driving a display panel according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, processes, operations, elements, and/or components, but do not preclude the presence or addition of one or more other features, regions, integers, processes, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, exemplary embodiments of the invention will be explained in detail with reference to the accompanying drawings.

Figure 2A:
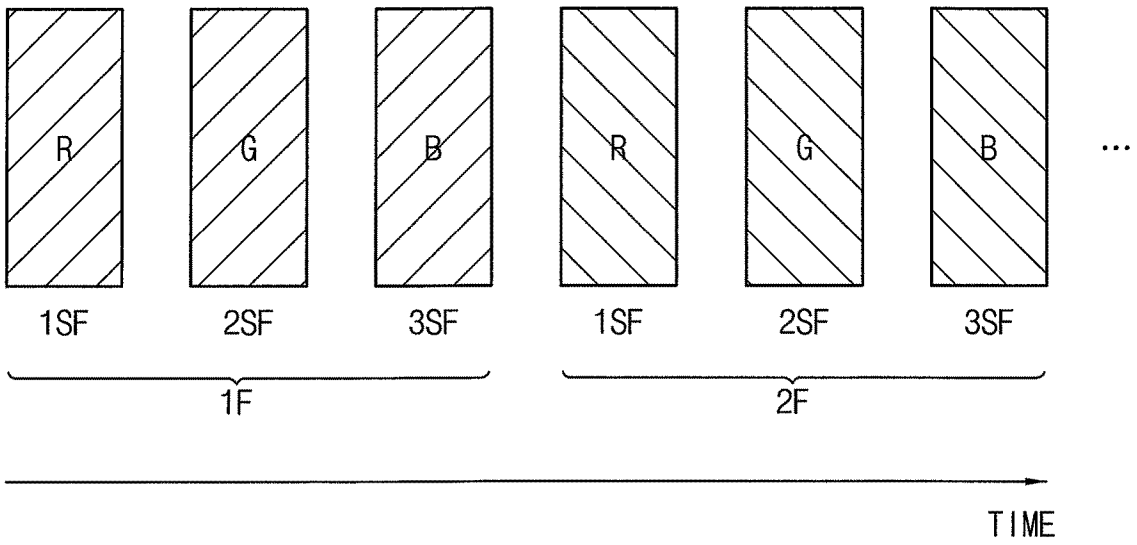
FIGS. 2A and 2B are diagrams for describing the method of FIG. 1.
Figure 2B:
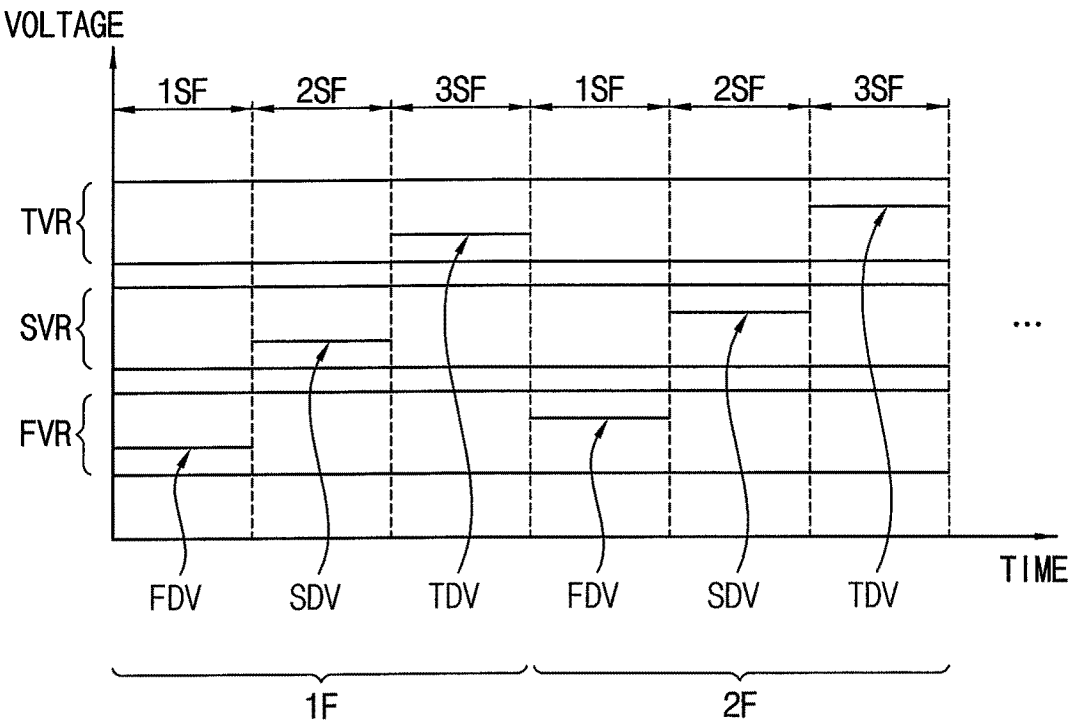

FIG. 1 is a flowchart illustrating a method of driving a display panel according to an exemplary embodiment, and FIGS. 2A and 2B are diagrams for describing the method of FIG. 1.

Referring to FIGS. 1 to 2B, in an exemplary embodiment, the method of FIG. 1 may be used to drive a display panel including a plurality of pixels, each of which outputs one of color lights, e.g., red ("R"), green ("G") and blue ("B"), corresponding to a voltage range FVR, SVR or TVR, to which a driving voltage FDV, SDV or TDV applied thereto belongs. In an exemplary embodiment, as shown in FIG. 1 to 2B, the method may include dividing one image frame into first through third sub-frames 1SF, 2SF and 3SF (S110), outputting a first color image displayed by a first color (e.g., R) by applying a first driving voltage FDV belonging to the first voltage range FVR to the pixels in the first sub-frame 1SF (S120), outputting a second color image displayed by a second color (e.g., G) by applying a second driving voltage SDV belonging to the second voltage range SVR to the pixels in the second sub-frame 2SF (S130), and outputting a third color image displayed by a third color (e.g., B) by applying a third driving voltage TDV belonging to the third voltage range TVR to the pixels in the third sub-frame 3SF (S140).

In an embodiment, the display panel may include the pixels, each of which outputs different color lights (e.g., R, QC and B) corresponding to the voltage ranges FVR, SVR, and TVR to which the driving voltage (i.e., the first driving voltage FDV, the second driving voltage SDV, or the third driving voltage TDV) applied thereto belongs. In such an embodiment, each of the pixels may include an organic light emitting element including dielectrophoresis materials. In one exemplary embodiment, for example, the organic light emitting element may have a structure in which different dielectric particles (e.g., dielectric particles having different dielectric constants) colored in different colors (e.g., R, C, and B) are disposed in a dielectric medium. In such an embodiment, the dielectric particles in each of the pixels may differently move in the dielectric medium when an electric field is generated in the structure as the driving voltage (e.g., the first driving voltage FDV, the second driving voltage SDV, or the third driving voltage TDV) is applied thereto. In such an embodiment, since a force applied to the dielectric particle is determined by a difference between a dielectric constant of the dielectric particle and a dielectric constant of the dielectric medium, the forces applied to the dielectric particles may be different due to the different dielectric constants of the dielectric particles. In such an embodiment, different electric fields may be generated in the structure when different driving voltages FDV, SDV and TDV are applied to each of the pixels. Thus, each of the pixels may output the different color lights R, G and B corresponding to the voltage ranges FVR, SVR, and TVR to which the driving voltage (e.g., the first driving voltage FDV, the second driving voltage SDV, or the third driving voltage TDV) applied thereto belongs. That is, each of the pixels may output the first color light (e.g., R) when the driving voltage (e.g., the first driving voltage FDV) applied thereto belongs to the first voltage range FVR, may output the second color light (e.g., G) when the driving voltage (e.g., the second driving voltage SDV) applied thereto belongs to the second voltage range SVR, and may output the third color light (e.g., B) when the driving voltage (e.g., the third driving voltage TDV) applied thereto belongs to the third voltage range TVR.

In an exemplary embodiment, as shown in FIG. 1, one image frame may be divided into the first through third sub-frames 1SF, 2SF, and 3SF (S110). In such an embodiment, as illustrated in FIGS. 2A and 2B, a first image frame 1F may be divided into the first through third sub-frames 1SF, 2SF and 3SF, a second image frame 2F following the first image frame 1F may be divided into the first through third sub-frames 1SF, 2SF and 3SF, and an n-th image frame nF, where n is an integer greater than or equal to 2, may be divided into the first through third sub-frames 1SF, 2SF and 3SF. Thus, n image frames may be divided into 3×n sub-frames and implemented by implementing the 3×n sub-frames.

In such an embodiment, as shown in FIG. 1, the first color image displayed by the first color (e.g., R) may be output by applying the first driving voltage FDV belonging to the first voltage range FVR to the pixels in the first sub-frame 1SF (S120). In an exemplary embodiment, the first color light (e.g., R) output from each of the pixels in the first sub-frame 1SF may be a red color light, and the first color image displayed on the display panel in the first sub-frame 1SF may be a red color image. In one exemplary embodiment, for example, as illustrated in FIG. 2B, the first voltage range FVR may be lower than the second voltage range SVR and the third voltage range TVR. Here, the pixels may output the red color light in response to the first driving voltage FDV belonging to the first voltage range FVR, and thus the display panel including the pixels may display the red color image. In FIG. 2B, the first driving voltage FDV applied to a pixel in the first sub-frame 1SF of the first image frame 1F is different from the first driving voltage FDV applied to the pixel in the first sub-frame 1SF of the second image frame 2F, but not being limited thereto. In such an embodiment, the first driving voltage FDV is determined to have a value within the first voltage range FVR based on luminance of the first color light (e.g., R) for the first sub-frame 1SF of each of the image frames 1F and 2F.

In such an embodiment, as shown in FIG. 1, the second color image displayed by the second color e.g., G) is output by applying the second driving voltage SDV belonging to the second voltage range SVR to the pixels in the second sub-frame 2SF (S130). In an exemplary embodiment, the second color light (e.g., G) output from each of the pixels in the second sub-frame 2SF may be a green color light, and the second color image displayed on the display panel in the second sub-frame 2SF may be a green color image. In one exemplary embodiment, for example, as illustrated in FIG. 2B, the second voltage range SVR may be higher than the first voltage range FVR and lower than the third voltage range TVR. In such an embodiment, the pixels may output the green color light in response to the second driving voltage SDV belonging to the second voltage range SVR, and thus the display panel including the pixels may display the green color image. In FIG. 2B, the second driving voltage SDV applied to a pixel in the second sub-frame 2SF of the first image frame 1F is different from the second driving voltage SDV applied to the pixel in the second sub-frame 2SF of the second image frame 2F, but not being limited thereto. In such an embodiment, the second driving voltage SDV is determined to have a value within the second voltage range SVR based on luminance of the second color light (e.g., G) for the second sub-frame 2SF of each of the image frames 1F and 2F.

In such an embodiment, as shown in FIG. 1, the third color image displayed by the third color (e.g., B) is output by applying the third driving voltage TDV belonging to the third voltage range TVR to the pixels in the third sub-frame 3SF (S140). In an exemplary embodiment, the third color light (e.g., B) output from each of the pixels in the third sub-frame 3SF may be a blue color light, and the third color image displayed on the display panel in the third sub-frame 3SF may be a blue color image. In one exemplary embodiment, for example, as illustrated in FIG. 2B, the third voltage range TVR may be higher than the first voltage range FVR and the second voltage range SVR. In such an embodiment, the pixels may output the blue color light in response to the third driving voltage TDV belonging to the third voltage range TVR, and thus the display panel including the pixels may display the blue color image. In FIG. 2B, the third driving voltage TDV applied to a pixel in the third sub-frame 3SF of the first image frame 1F is different from the third driving voltage TDV applied to the pixel in the third sub-frame 3SF of the second image frame 2F, but not being limited thereto. In such an embodiment, the third driving voltage TDV is determined to have a value within the third voltage range TVR based on luminance of the third color light (e.g., B) for the third sub-frame 3SF of each of the image frames 1F and 2F.

In an exemplary embodiment, as described above, the method of FIG. 1 may be used to drive the display panel including the pixels, each of which outputs the first through third color lights (e.g., R, G, and B) in response to the first through third driving voltages FDV, SDV and TDV, where the first through third driving voltages FDV, SDV and TDV belong to the first through third voltage ranges FVR, SVR and TVR, respectively. In such an embodiment, the method of FIG. 1 may be used to efficiently drive such a display panel by driving the display panel using a field sequential driving technique that divides one image frame into the first through third sub-frames 1SF 2SF, and 3SF, and applying the first through third driving voltages FDV, SDV and TDV to the pixels in the first through third sub-frames 1SF, 2SF and 3SF, respectively. In an exemplary embodiment, as illustrated in FIGS. 1 to 2B, the first color light (e.g., R) output from each of the pixels in response to the first driving voltage FDV is the red color light, the second color light (e.g., G) output from each of the pixels in response to the second driving voltage SDV is the green color light, and the third color light (e.g., B) output from each of the pixels in response to the third driving voltage TDV is the blue color light, but the invention is not limited thereto. In one exemplary embodiment, for example, the first color light output from each of the pixels in response to the first driving voltage FDV, the second color light output from each of the pixels in response to the second driving voltage SDV, and the third color light output from each of the pixels in response to the third driving voltage TDV may variously be determined among the red color light, the green color light, and the blue color light, to be different from each other.

Figure 3:
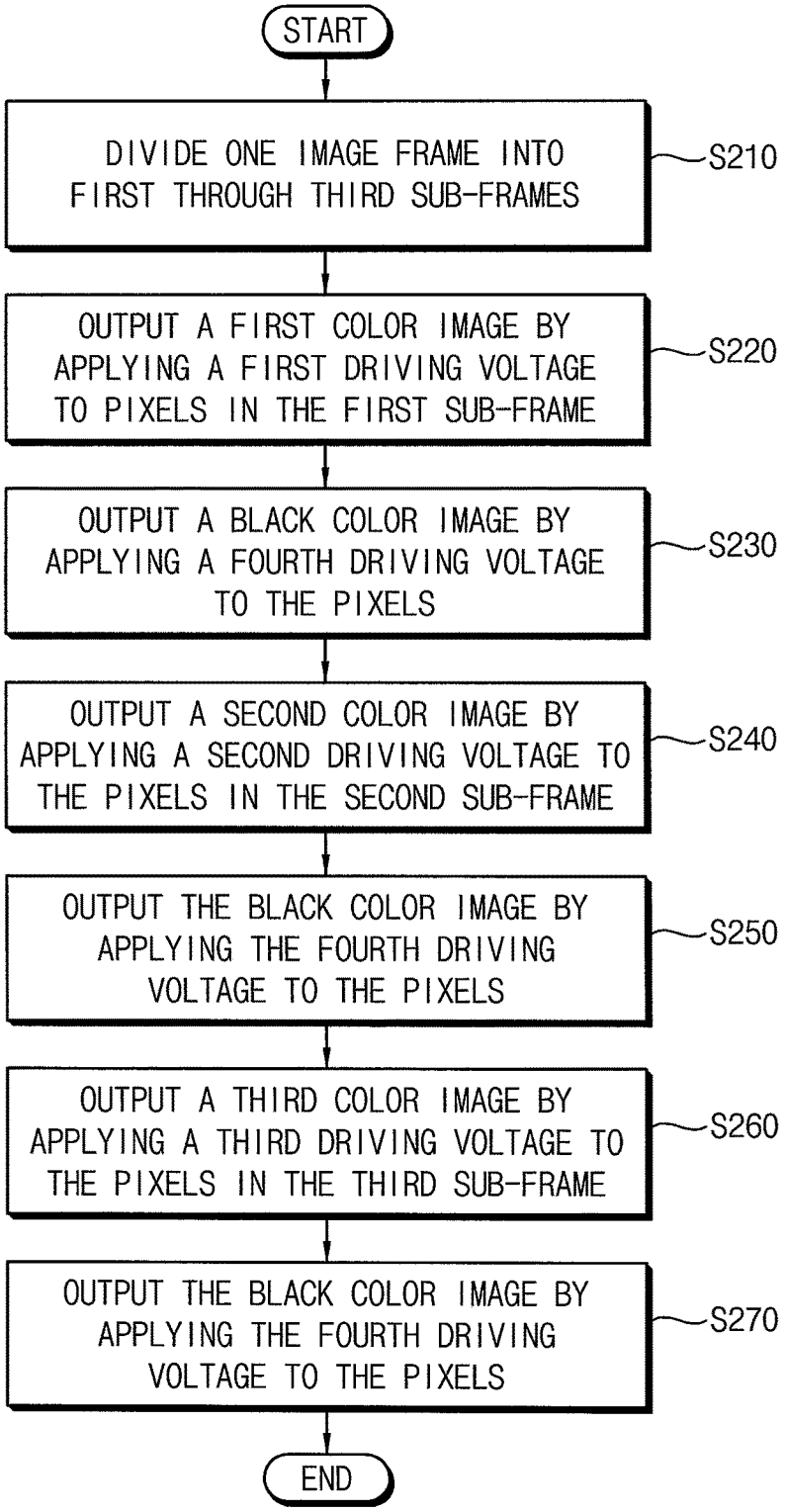
FIG. 3 is a flowchart illustrating a method of driving a display panel according to an alternative exemplary embodiment.
Figure 4A:
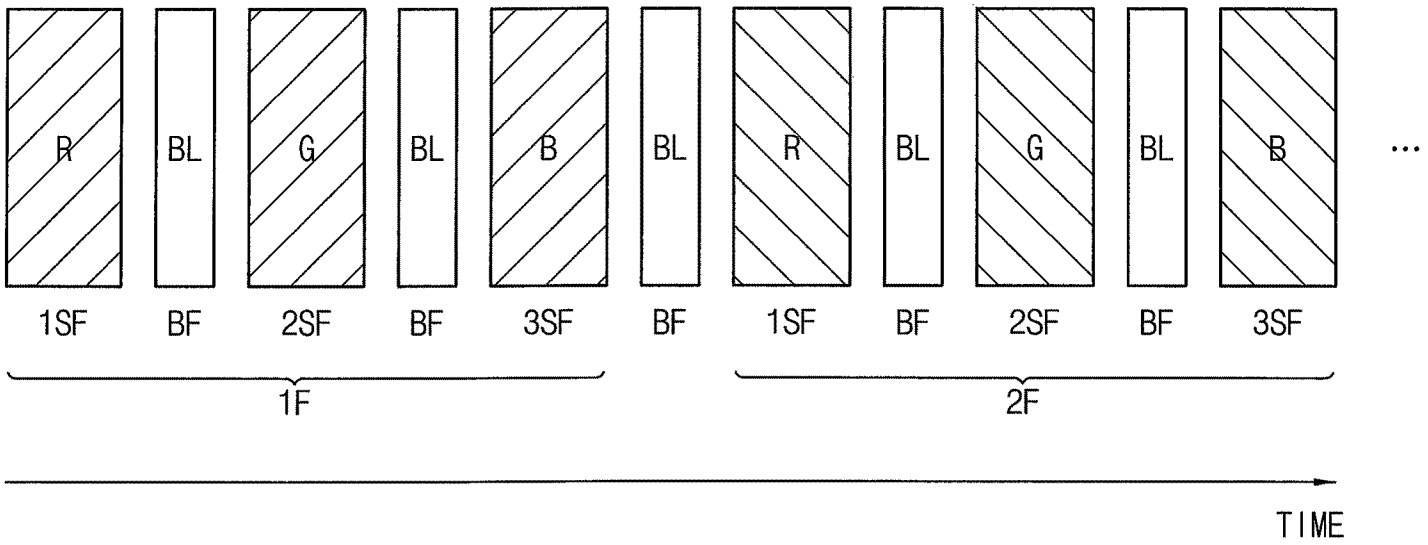
FIGS. 4A and 4B are diagrams for describing the method of FIG. 3.
Figure 4B:
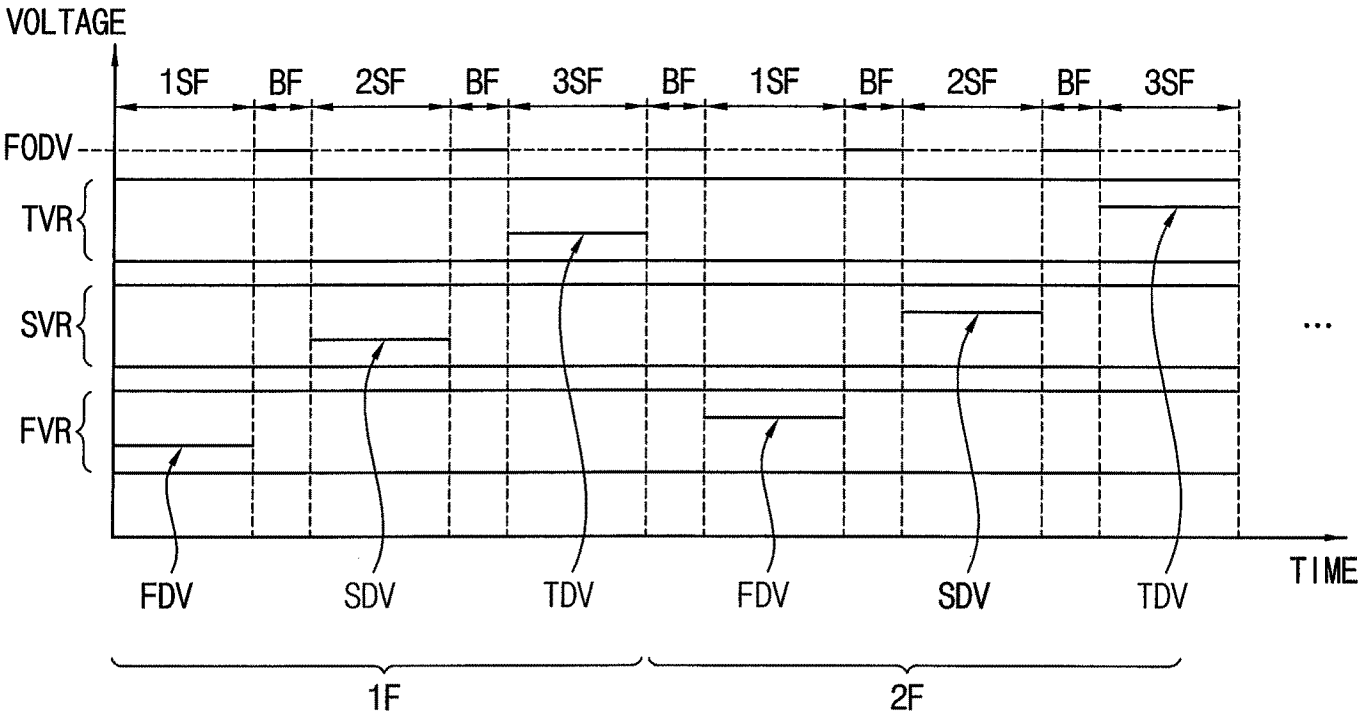

FIG. 3 is a flowchart illustrating a method of driving a display panel according to an alternative exemplary embodiment, and FIGS. 4A and 4B are diagrams for describing the method of FIG. 3.

Referring to FIGS. 3 to 4B, in an exemplary embodiment, the method of FIG. 3 may be used to drive a display panel including a plurality of pixels, each of which outputs different color lights (e.g., R, GC and B) corresponding to voltage ranges FVR, SVR, and TVR to which a driving voltage (i.e., FDV, SDV, or TDV) belongs. In such an embodiment, as shown in FIG. 3, the method may include dividing one image frame (e.g., 1F) into first through third sub-frames 1SF, 2SF, and 3SF (S210), outputting a first color image displayed by a first color (e.g., R) by applying the first driving voltage FDV belonging to the first voltage range FVR to the pixels in the first sub-frame 1SF (S220), outputting a black color image BL by applying a fourth driving voltage FODV to the pixels between the first sub-frame 1SF and the second sub-frame 2SF (S230), outputting a second color image displayed by a second color (e.g., G) by applying the second driving voltage SDV belonging to the second voltage range SVR to the pixels in the second sub-frame 2SF (S240), outputting the black color image BL by applying the fourth driving voltage FODV to the pixels between the second sub-frame 2SF and the third sub-frame 3SF (S250), outputting a third color image displayed by a third color (e.g., B) by applying the third driving voltage TDV belonging to the third voltage range TVR to the pixels in the third sub-frame 3SF (S260), and outputting the black color image BL by applying the fourth driving voltage FODV to the pixels between the third sub-frame 3SF and a next image frame (e.g., 2F) (S270). Since the method of FIG. 3 is substantially the same as the method of FIG. 1 except for the processes S230, S250 and S270, any repetitive detailed description of the same or like elements will be omitted or simplified. Thus, the processes S230, S250 and S270 of the method of FIG. 3 will hereinafter be described in detail.

In such an embodiment, the method of FIG. 3 may effectively prevent a color break-up phenomenon by inserting a black color frame BF between two adjacent sub-frames of the first through third sub-frames 1SF, 2SF and 3SF (e.g., performing a black color data insertion) when implementing one image frame by dividing one image frame into the first through third sub-frames 1SF, 2SF and 3SF. In such an embodiment, the method of FIG. 3 may effectively prevent an interference phenomenon between the first sub-frame 1SF and the second sub-frame 2SF by outputting the black color image BL by applying the fourth driving voltage FODV to the pixels between the first sub-frame 1SF and the second sub-frame 2SF (S230), may effectively prevent an interference phenomenon between the second sub-frame 2SF and the third sub-frame 3SF by outputting the black color image BL by applying the fourth driving voltage FODV to the pixels between the second sub-frame 2SF and the third sub-frame 3SF (S250), and may effectively prevent an interference phenomenon between the third sub-frame 3SF and the first sub-frame 1SF of the next image frame by outputting the black color image BL by applying the fourth driving voltage FODV to the pixels between the third sub-frame 3SF and the next image frame (S270). In an exemplary embodiment, the first voltage range FVR to which the first driving voltage FDV belongs may be lower than the second voltage range SVR to which the second driving voltage SDV belongs, the second voltage range SVR to which the second driving voltage SDV belongs may be lower than the third voltage range TVR to which the third driving voltage TDV belongs, and the third voltage range TVR to which the third driving voltage TDV belongs may be lower than the fourth driving voltage FODV. However, the invention is not limited thereto. In an exemplary embodiment, as described above, the method of FIG. 3 may provide a high-quality image to a viewer (or, user) by preventing the color break-up phenomenon by inserting the black color frame BF between adjacent ones of the first through third sub-frames 1SF, 2SF, and 3SF.

Figure 5:
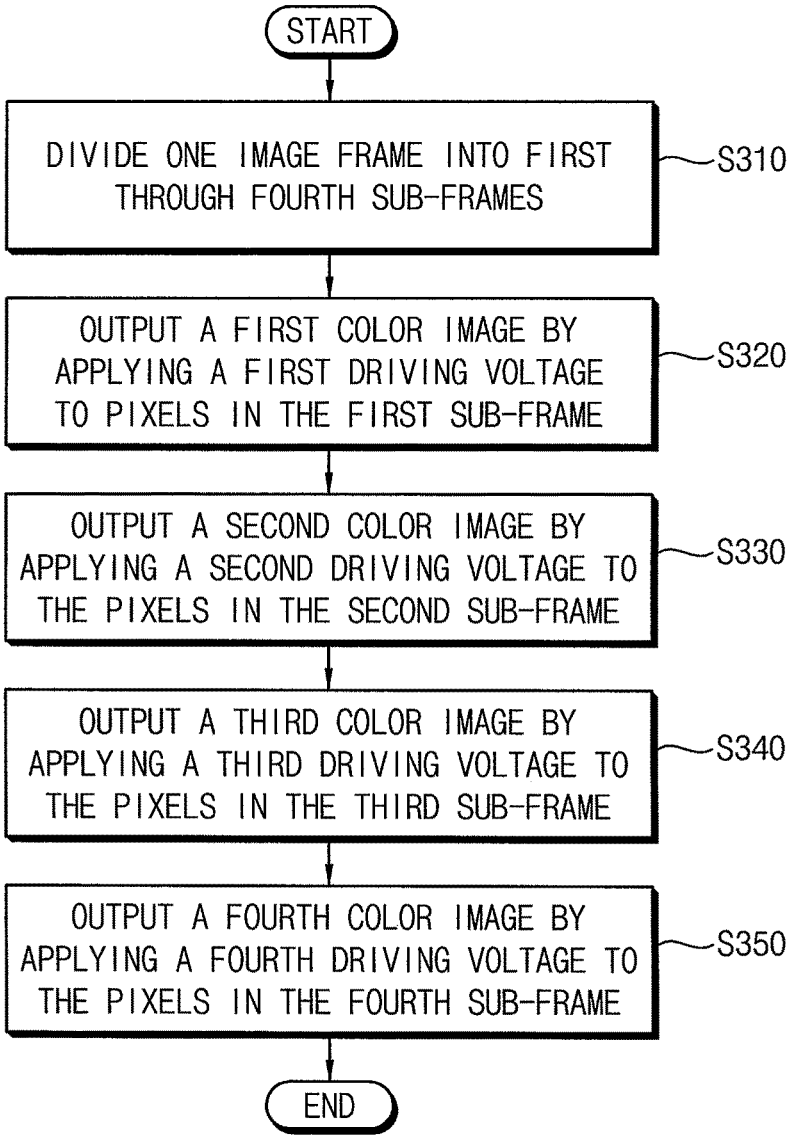
FIG. 5 is a flowchart illustrating a method of driving a display panel according to another alternative exemplary embodiment.
Figure 6A:
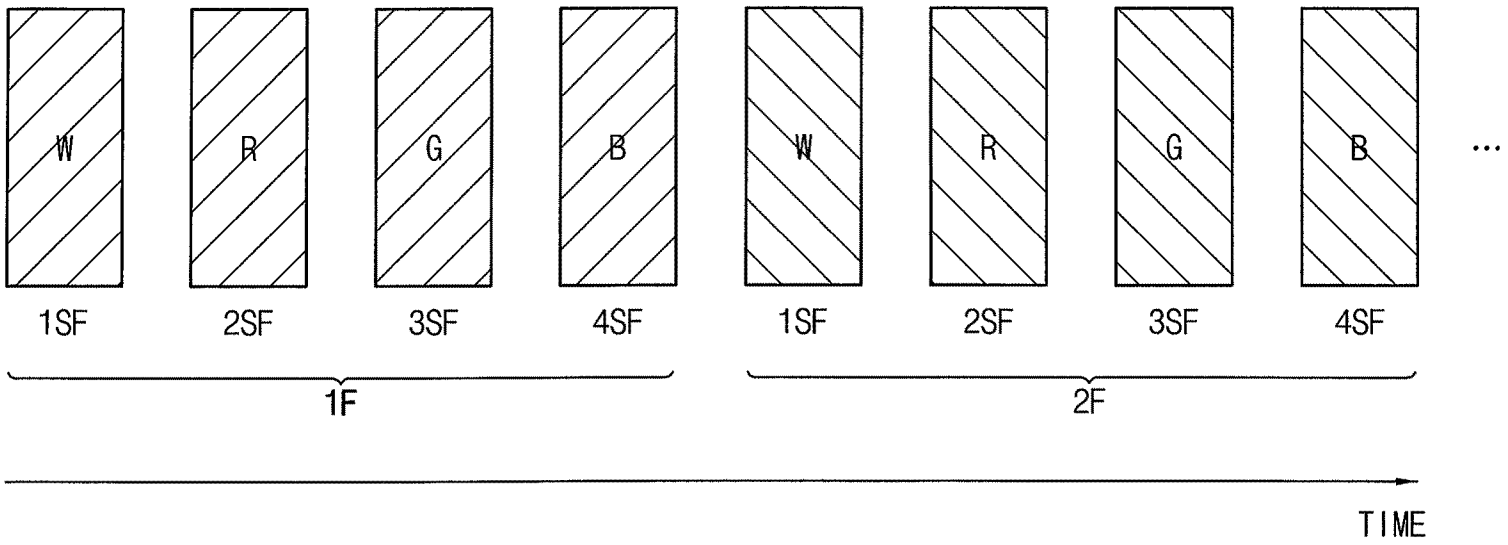
FIGS. 6A and 6B are diagrams for describing the method of FIG. 5.
Figure 6B:
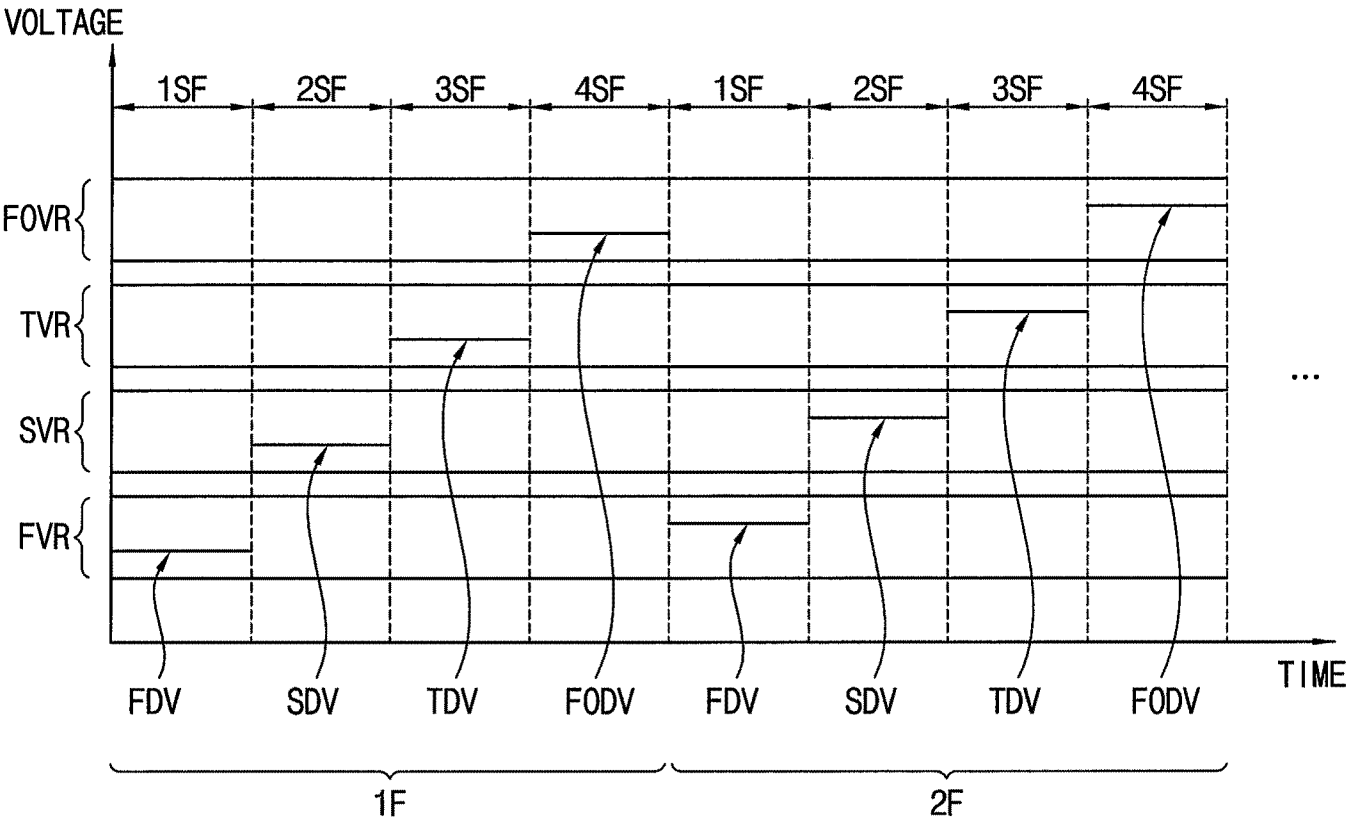

FIG. 5 is a flowchart illustrating a method of driving a display panel according to another alternative exemplary embodiment, and FIGS. 6A and 6B are diagrams for describing the method of FIG. 5.

Referring to FIGS. 5 to 6B, the method of FIG. 5 may be used to drive a display panel including a plurality of pixels, each of which outputs different color lights, e.g., white ("W"), R, G and B, corresponding to voltage ranges FVR, SVR, TVR and FOVR to which a driving voltage (i.e., FDV, SDV, TDV, or FODV) applied thereto belongs. In such an embodiment, the method of FIG. 5 may include dividing one image frame into first through fourth sub-frames 1SF, 2SF, 3SF, and 4SF (S310), outputting a first color image displayed by a first color (e.g., W) by applying the first driving voltage FDV belonging to the first voltage range FVR to the pixels in the first sub-frame 1SF (S320), outputting a second color image displayed by a second color (e.g., R) by applying the second driving voltage SDV belonging to the second voltage range SVR to the pixels in the second sub-frame 2SF (S330), outputting a third color image displayed by a third color (e.g., G) by applying the third driving voltage TDV belonging to the third voltage range TVR to the pixels in the third sub-frame 3SF (S340), and outputting a fourth color image displayed by a fourth color (e.g., B) by applying the fourth driving voltage FODV belonging to the fourth voltage range FOVR to the pixels in the fourth sub-frame 4SF (S350).

The display panel may include the pixels, each of which outputs the different color lights (e.g., W, R, G and B) corresponding to the voltage ranges FVR, SVR, TVR and FOVR to which the driving voltage (e.g., a first driving voltage FDV, a second driving voltage SDV, a third driving voltage TDV or a fourth driving voltage FODV) applied thereto belongs. In such an embodiment, each of the pixels may include an organic light emitting element including dielectrophoresis materials. Thus, each of the pixels may output the first color light (e.g., W) when the driving voltage (e.g., the first driving voltage FDV) applied thereto belongs to the first voltage range FVR, may output the second color light (e.g., R) when the driving voltage (e.g., the second driving voltage SDV) applied thereto belongs to the second voltage range SVR, may output the third color light (e.g., G) when the driving voltage (e.g., the third driving voltage TDV) applied thereto belongs to the third voltage range TVR, and may output the fourth color light (e.g., B) when the driving voltage (e.g., the fourth driving voltage FODV) applied thereto belongs to the fourth voltage range FOVR.

In such an embodiment, the method of FIG. 5 may include dividing one image frame into the first through fourth sub-frames 1SF, 2SF, 3SF, and 4SF (S310). In such an embodiment, as illustrated in FIGS. 6A and 6B, a first image frame 1F may be divided into the first through fourth sub-frames 1SF, 2SF, 3S and 4SF, a second image frame 2F following the first image frame 1F may be divided into the first through fourth sub-frames 1SF, 2SF, 3SF and 4SF, and an n-th image frame nF may be divided into the first through fourth sub-frames 1SF, 2SF, 3SF, and 4SF. Thus, n image frames may be divided into 4×n sub-frames and implemented by implementing the 4×n sub-frames.

In such an embodiment, the method of FIG. 5 may include outputting the first color image displayed by the first color (e.g., W) by applying the first driving voltage FDV belonging to the first voltage range FVR to the pixels in the first sub-frame 1SF (S320). In an exemplary embodiment, the first color light (e.g., W) output from each of the pixels in the first sub-frame 1SF may be a white color light, and the first color image displayed on the display panel in the first sub-frame 1SF may be a white color image. In one exemplary embodiment, for example, as illustrated in FIG. 6B, the first voltage range FVR may be lower than the second voltage range SVR, the third voltage range TVR, and the fourth voltage range FOVR. In such an embodiment, the pixels may output the white color light in response to the first driving voltage FDV belonging to the first voltage range FVR, and thus the display panel including the pixels may display the white color image. In FIG. 6B, the first driving voltage FDV applied to a pixel in the first sub-frame 1SF of the first image frame 1F is different from the first driving voltage FDV applied to the pixel in the first sub-frame 1SF of the second image frame 2F, but not being limited thereto. In such an embodiment, the first driving voltage FDV is determined to have value within the first voltage range FVR based on luminance of the first color light (e.g., W) for the first sub-frame 1SF of each of the image frames 1F and 2F.

In such an embodiment, the method of FIG. 5 may further include outputting the second color image displayed by the second color (e.g., R) by applying the second driving voltage SDV belonging to the second voltage range SVR to the pixels in the second sub-frame 2SF (S330). In an exemplary embodiment, the second color light (e.g., R) output from each of the pixels in the second sub-frame 2SF may be a red color light, and the second color image displayed on the display panel in the second sub-frame 2SF may be a red color image. In one exemplary embodiment, for example, as illustrated in FIG. 6B, the second voltage range SVR may be higher than the first voltage range FVR and lower than the third voltage range TVR and the fourth voltage range FOVR. In such an embodiment, the pixels may output the red color light in response to the second driving voltage SDV belonging to the second voltage range SVR, and thus the display panel including the pixels may display the red color image. In FIG. 6B, the second driving voltage SDV applied to a pixel in the second sub-frame 2SF of the first image frame 1F is different from the second driving voltage SDV applied to the pixel in the second sub-frame 2SF of the second image frame 2F, but not being limited thereto. In such an embodiment, the second driving voltage SDV is determined to have a value within the second voltage range SVR based on luminance of the second color light (e.g., R) for the second sub-frame 2SF of each of the image frames 1F and 2F.

In such an embodiment, the method of FIG. 5 may further include outputting the third color image displayed by the third color (e.g., G) by applying the third driving voltage TDV belonging to the third voltage range TVR to the pixels in the third sub-frame 3SF (S340). In an exemplary embodiment, the third color light (e.g., G) output from each of the pixels in the third sub-frame 3SF may be a green color light, and the third color image displayed on the display panel in the third sub-frame 3SF may be a green color image. In one exemplary embodiment, for example, as illustrated in FIG. 6B, the third voltage range TVR may be higher than the first voltage range FVR and the second voltage range SVR and lower than the fourth voltage range FOVR. In such an embodiment, the pixels may output the green color light in response to the third driving voltage TDV belonging to the third voltage range TVR, and thus the display panel including the pixels may display the green color image. In FIG. 6B, the third driving voltage TDV applied to a pixel in the third sub-frame 3SF of the first image frame 1F is different from the third driving voltage TDV applied to the pixel in the third sub-frame 3SF of the second image frame 2F, but not being limited thereto. In such an embodiment, the third driving voltage TDV is determined to have a value within the third voltage range TVR based on luminance of the third color light (e.g., G) for the third sub-frame 3SF of each of the image frames 1F and 2F.

In such an embodiment, the method of FIG. 5 may further include outputting the fourth color image displayed by the fourth color (e.g., B) by applying the fourth driving voltage FODV belonging to the fourth voltage range FOVR to the pixels in the fourth sub-frame 4SF (S350). In an exemplary embodiment, the fourth color light (e.g., B) output from each of the pixels in the fourth sub-frame 4SF may be a blue color light, and the fourth color image displayed on the display panel in the fourth sub-frame 4SF may be a blue color image. In one exemplary embodiment, for example, as illustrated in FIG. 6B, the fourth voltage range FOVR may be higher than the first voltage range FVR, the second voltage range SVR, and the third voltage range TVR. In such an embodiment, the pixels may output the blue color light in response to the fourth driving voltage FODV belonging to the fourth voltage range FOVR, and thus the display panel including the pixels may display the blue color image. In FIG. 6B, the fourth driving voltage FODV applied to a pixel in the fourth sub-frame 4SF of the first image frame 1F is different from the fourth driving voltage FODV applied to the pixel in the fourth sub-frame 4SF of the second image frame 2F, but not being limited thereto. In such an embodiment, the fourth driving voltage FODV is determined to have a value within the fourth voltage range FOVR based on luminance of the fourth color light (e.g., B) for the fourth sub-frame 4SF of each of the image frames 1F and 2F.

In an exemplary embodiment, as described above, the method of FIG. 5 may be used to drive the display panel including the pixels, each of which outputs the first through fourth color lights (e.g., W, R, C and B) in response to the first through fourth driving voltages FDV, SDV, TDV and FODV, where the first through fourth driving voltages FDV, SDV, TDV and FODV belong to the first through fourth voltage ranges FVR, SVR, TVR and FOVR, respectively. In such an embodiment, the method of FIG. 5 may be used to efficiently drive such a display panel by driving the display panel using a field sequential driving technique that divides one image frame into the first through fourth sub-frames 1SF, 2SF, 3SF and 4SF and applying the first through fourth driving voltages FDV, SDV, TDV and FODV to the pixels in the first through fourth sub-frames 1SF, 2SF, 3SF and 4SF, respectively. In an exemplary embodiment, as illustrated in FIGS. 5 to 6B, the first color light (e.g., W) output from each of the pixels in response to the first driving voltage FDV is the white color light, the second color light (e.g., R) output from each of the pixels in response to the second driving voltage SDV is the red color light, the third color light (e.g., G) output from each of the pixels in response to the third driving voltage TDV is the green color light, and the fourth color light (e.g., B) output from each of the pixels in response to the fourth driving voltage FODV is the blue color light, but the invention is not limited thereto. In one exemplary embodiment, for example, the first color light output from each of the pixels in response to the first driving voltage FDV, the second color light output from each of the pixels in response to the second driving voltage SDV, the third color light output from each of the pixels in response to the third driving voltage TDV, and the fourth color light output from each of the pixels in response to the fourth driving voltage FODV may be variously determined among the white color light, the red color light, the green color light, and the blue color light, differently to each other.

Figure 7:
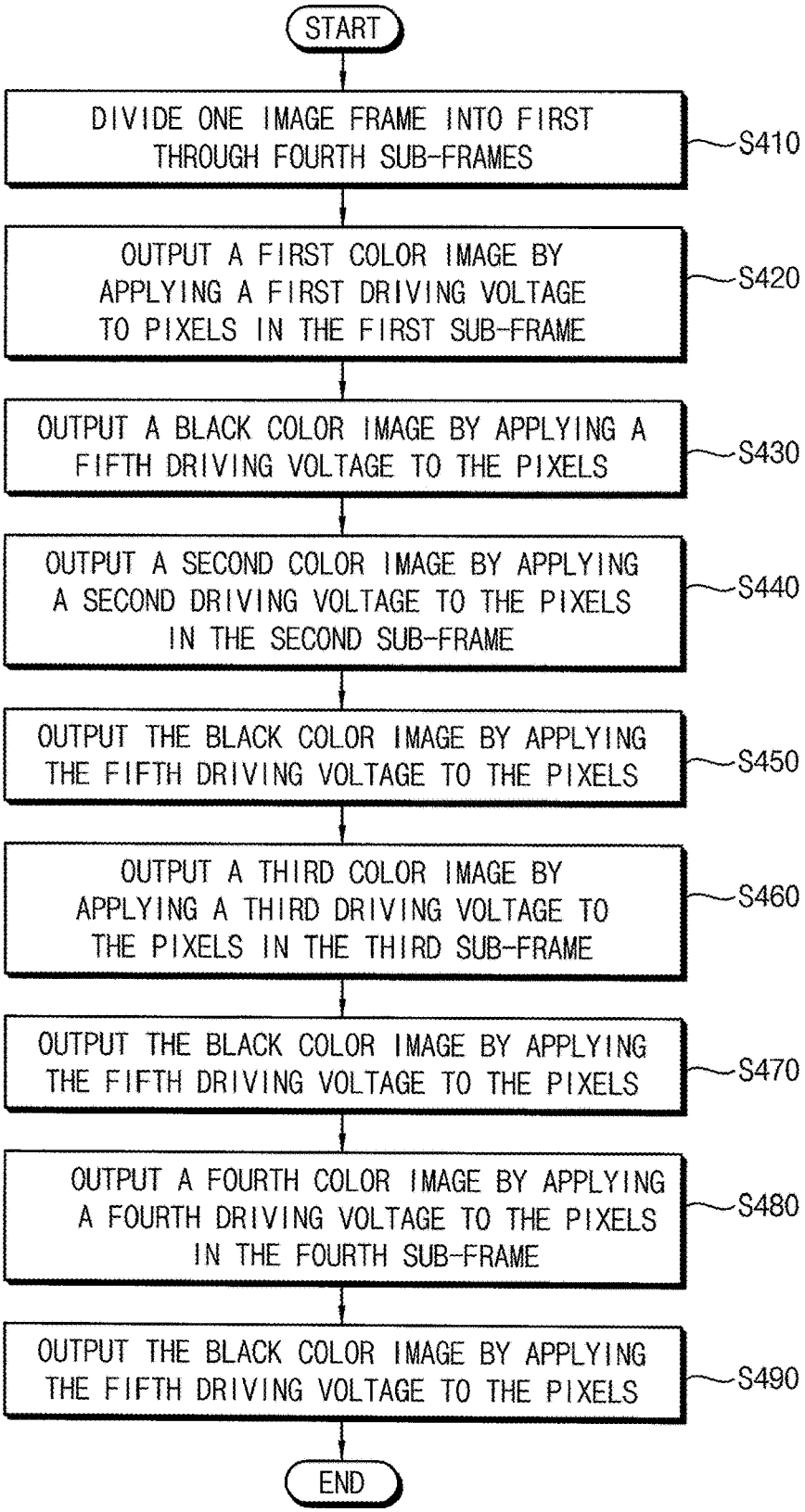
FIG. 7 is a flowchart illustrating a method of driving a display panel according to another alternative exemplary embodiment.
Figure 8A:
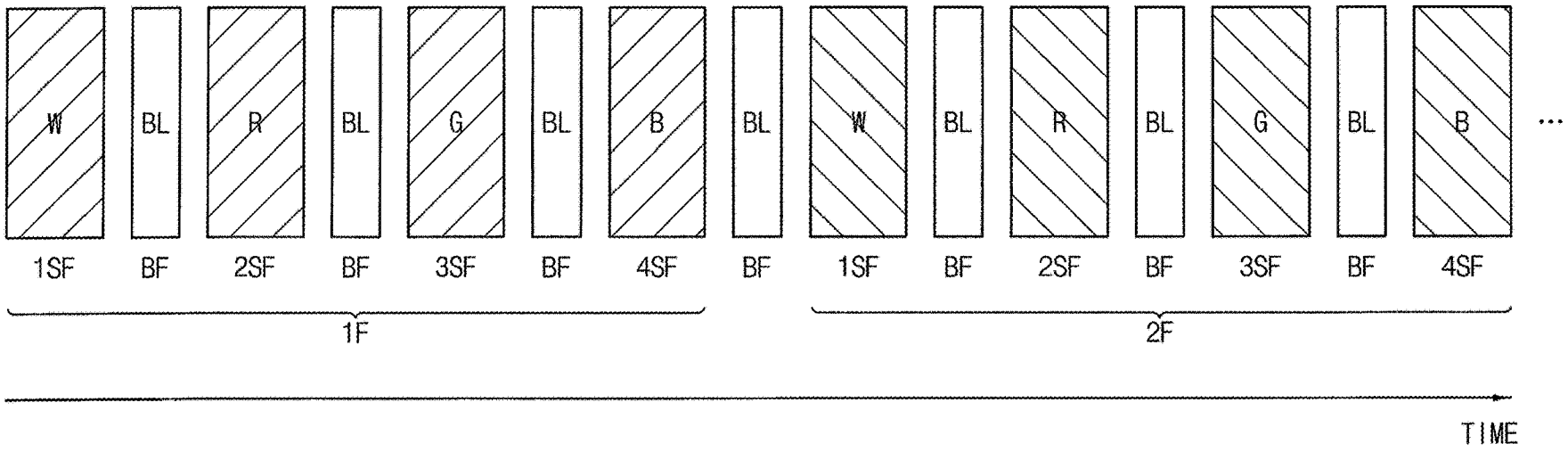
FIGS. 8A and 8B are diagrams for describing the method of FIG. 7.
Figure 8B:
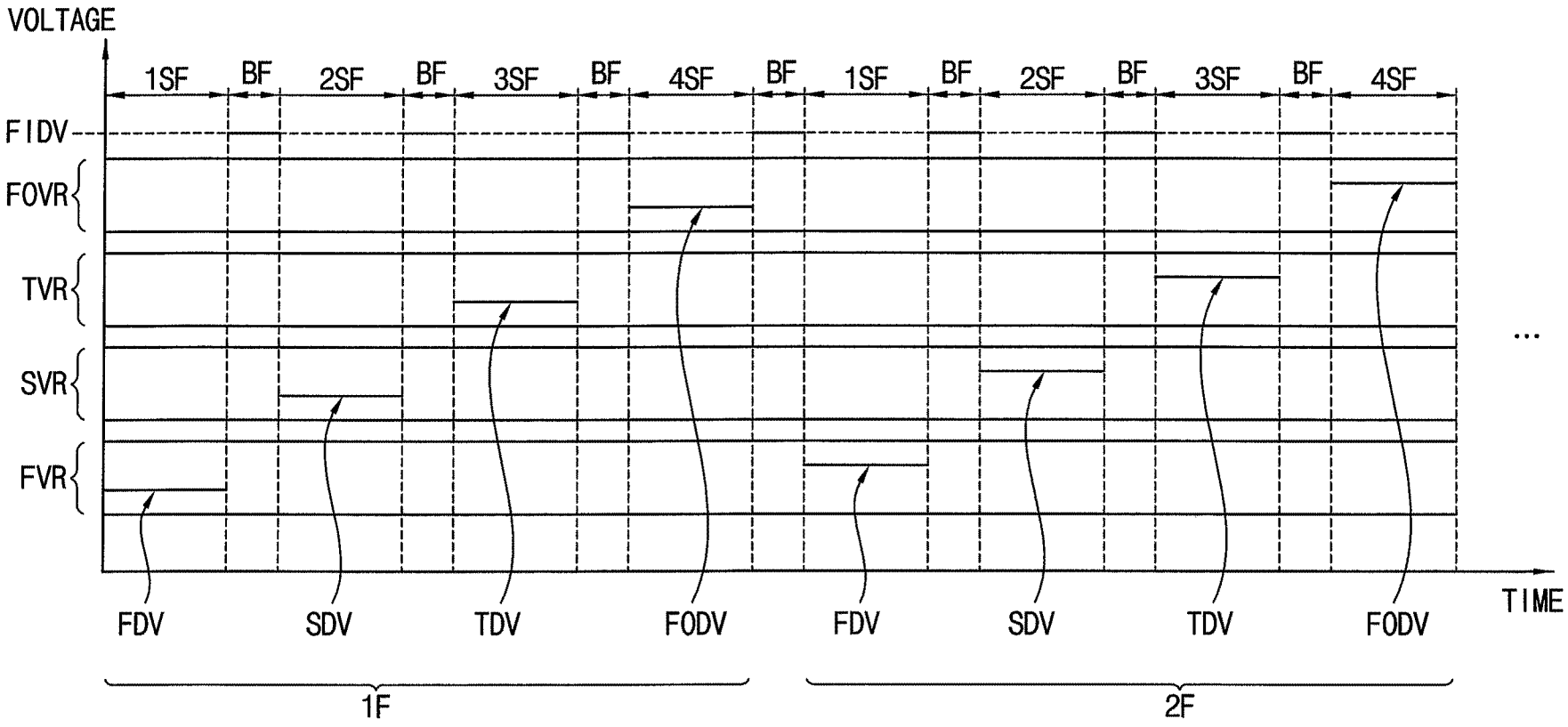

FIG. 7 is a flowchart illustrating a method of driving a display panel according to an exemplary embodiment, and FIGS. 8A and 8B are diagrams for describing the method of FIG. 7.

Referring to FIGS. 7 to 8B, the method of FIG. 7 may be used to drive a display panel including a plurality of pixels, each of which outputs different color lights (e.g., W, R, GC and B) corresponding to voltage ranges FVR, SVR, TVR and FOVR to which a driving voltage (i.e., FDV, SDV, TDV, or FODV) belongs. In such an embodiment, the method of FIG. 7 may include dividing one image frame (e.g., 1F) into first through fourth sub-frames 1SF, 2SF, 3SF, and 4SF (S410), outputting a first color image displayed by a first color (e.g., W) by applying the first driving voltage FDV belonging to the first voltage range FVR to the pixels in the first sub-frame 1SF (S420), outputting a black color image BL by applying a fifth driving voltage FIDV to the pixels between the first sub-frame 1SF and the second sub-frame 2SF (S430), outputting a second color image displayed by a second color (e.g., R) by applying the second driving voltage SDV belonging to the second voltage range SVR to the pixels in the second sub-frame 2SF (S440), outputting the black color image BL by applying the fifth driving voltage FIDV to the pixels between the second sub-frame 2SF and the third sub-frame 3SF (S450), may output a third color image displayed by a third color (e.g., G) by applying the third driving voltage TDV belonging to the third voltage range TVR to the pixels in the third sub-frame 3SF (S460), outputting the black color image BL by applying the fifth driving voltage FIDV to the pixels between the third sub-frame 3SF and the fourth sub-frame 4SF (S470), outputting a fourth color image displayed by a fourth color (e.g., B) by applying the fourth driving voltage FODV belonging to the fourth voltage range FOVR to the pixels in the fourth sub-frame 4SF (S480), and outputting the black color image BL by applying the fifth driving voltage FIDV to the pixels between the fourth sub-frame 4SF and a next image frame (e.g., 2F) (S490). Since the method of FIG. 7 is substantially the same as the method of FIG. 5 except the processes S430, S450, S470 and S490, any repetitive detailed description of same or like elements will be omitted or simplified. Thus, the method of FIG. 7 will be described focusing on the processes S430, S450, S470 and S490.

In an exemplary embodiment, the method of FIG. 7 may be used to effectively prevent a color break-up phenomenon by inserting a black color frame BF between adjacent ones of the first through fourth sub-frames 1SF, 2SF, 3SF and 4SF (i.e., performing a black color data insertion) when implementing one image frame by dividing one image frame into the first through fourth sub-frames 1SF, 2SF, 3SF and 4SF. In such an embodiment, the method of FIG. 7 may be used to effectively prevent an interference phenomenon between the first sub-frame 1SF and the second sub-frame 2SF by outputting the black color image BL by applying the fifth driving voltage FIDV to the pixels between the first sub-frame 1SF and the second sub-frame 2SF (S430), to effectively prevent an interference phenomenon between the second sub-frame 2SF and the third sub-frame 3SF by outputting the black color image BL by applying the fifth driving voltage FIDV to the pixels between the second sub-frame 2SF and the third sub-frame 3SF (S450), to effectively prevent an interference phenomenon between the third sub-frame 3SF and the fourth sub-frame 4SF by outputting the black color image BL by applying the fifth driving voltage FIDV to the pixels between the third sub-frame 3SF and the fourth sub-frame 4SF (S470), and to effectively prevent an interference phenomenon between the fourth sub-frame 4SF and the first sub-frame 1SF of the next image frame by outputting the black color image BL by applying the fifth driving voltage FIDV to the pixels between the fourth sub-frame 4SF and the next image frame (S490). In an exemplary embodiment, the first voltage range FVR to which the first driving voltage FDV belongs may be lower than the second voltage range SVR to which the second driving voltage SDV belongs, the second voltage range SVR to which the second driving voltage SDV belongs may be lower than the third voltage range TVR to which the third driving voltage TDV belongs, the third voltage range TVR to which the third driving voltage TDV belongs may be lower than the fourth voltage range FOVR to which the fourth driving voltage FODV belongs, and the fourth voltage range FOVR to which the fourth driving voltage FODV belongs may be lower than the fifth driving voltage FIDV. However, the invention is not limited thereto. As described above, the method of FIG. 7 may be used to provide a high-quality image to a viewer by preventing the color break-up phenomenon by inserting the black color frame BF between adjacent ones of the first through fourth sub-frames 1SF, 2SF, 3SF, and 4SF.

Figure 9:
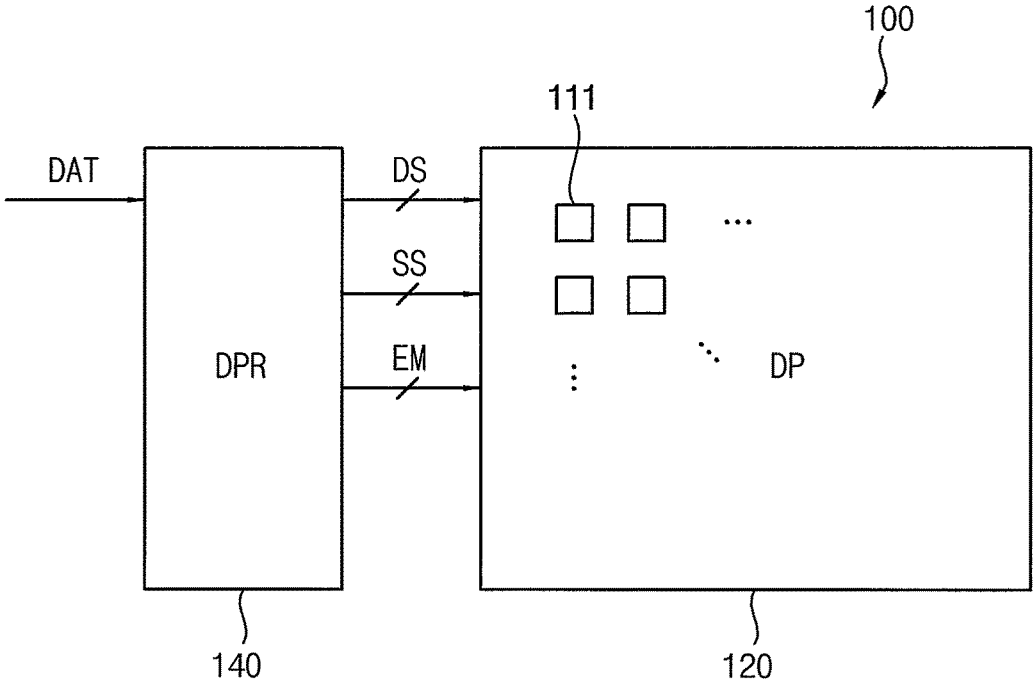
FIG. 9 is a block diagram illustrating a display device according to an exemplary embodiment.
Figure 10:
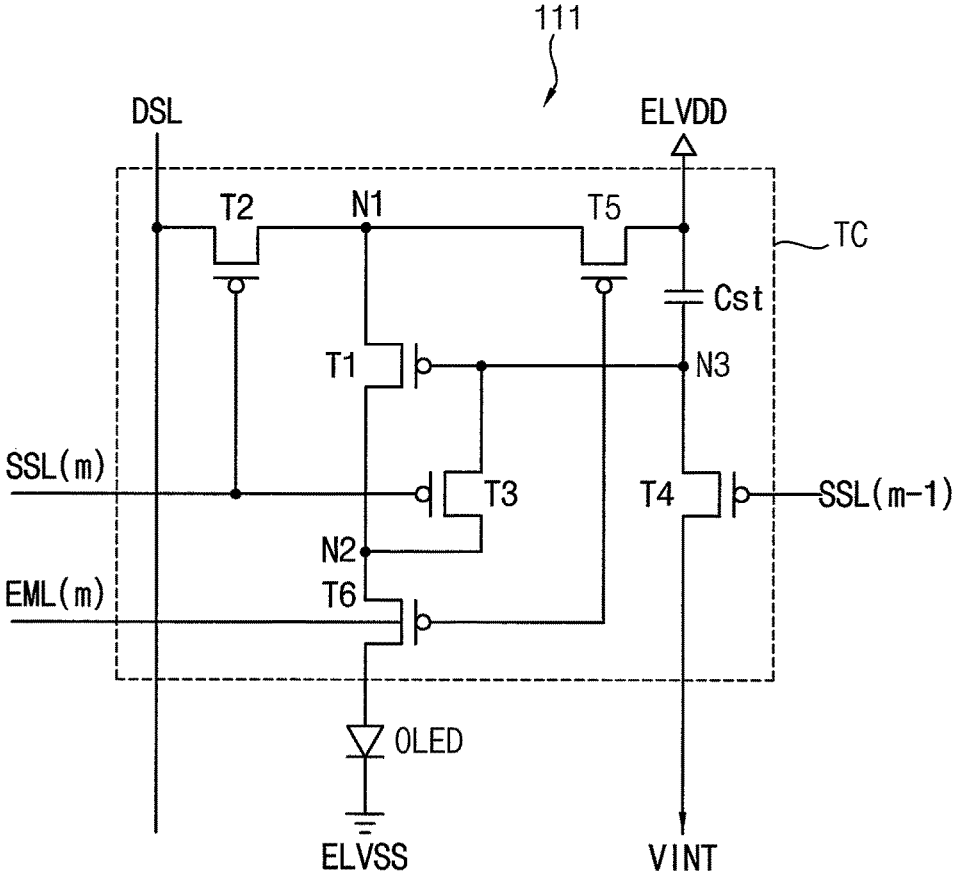
FIG. 10 is a circuit diagram illustrating an exemplary embodiment of a pixel included in a display panel of the display device of FIG. 9.
Figure 11:
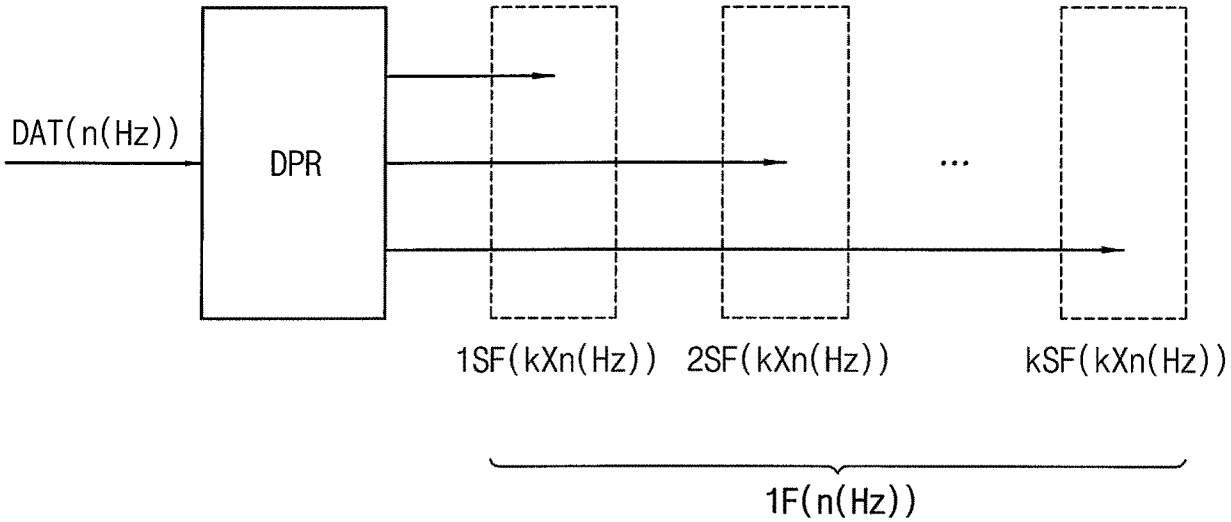
FIG. 11 is a diagram illustrating an operation of an exemplary embodiment of a display panel driving circuit in the display device of FIG. 9.
Figure 12:
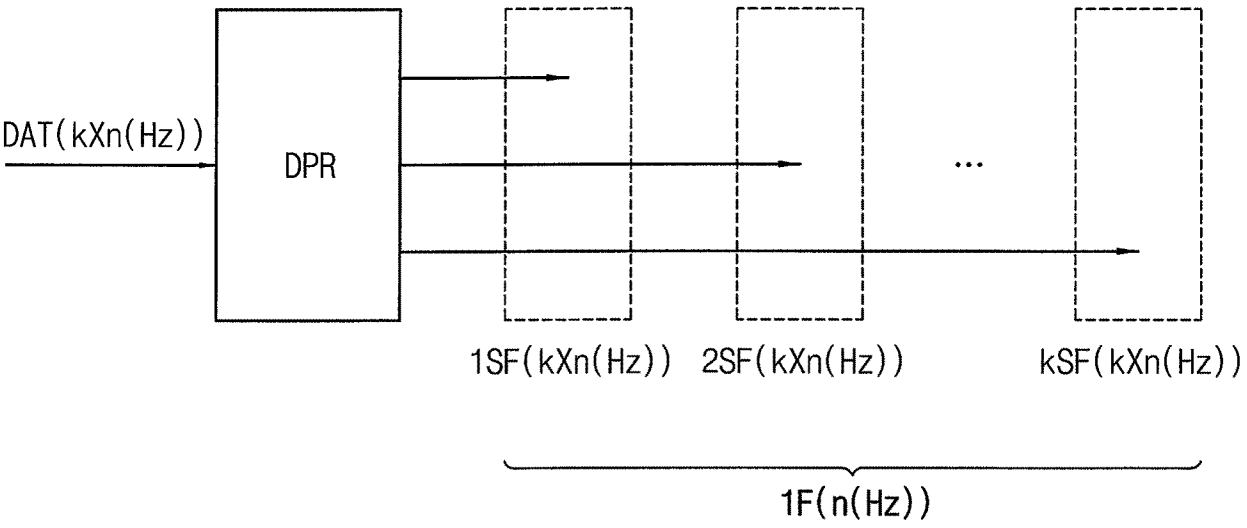
FIG. 12 is a diagram illustrating an operation of an alternative exemplary embodiment of a display panel driving circuit in the display device of FIG. 9.

FIG. 9 is a block diagram illustrating a display device according to an exemplary embodiment, FIG. 10 is a circuit diagram illustrating an example of a pixel included in a display panel of the display device of FIG. 9, FIG. 11 is a diagram illustrating an example in which a display panel driving circuit operates in the display device of FIG. 9, and FIG. 12 is a diagram illustrating another example in which a display panel driving circuit operates in the display device of FIG. 9.

Referring to FIGS. 9 to 12, an exemplary embodiment of the display device 100 may include a display panel (DP in FIG. 9) 120 and a display panel driving circuit (DPR in FIGS. 9, 11 and 12) 140. In an exemplary embodiment, the display device 100 may be an organic light emitting display ("OLED") device.

The display panel 120 may include a plurality of pixels 111, each of which outputs first through k-th color lights, where k is an integer greater than or equal to 2, in response to first through k-th driving voltages, where the first through k-th driving voltages belong to first through k-th voltage ranges, respectively. In an exemplary embodiment of the display panel 120, the pixels 111 may be arranged substantially in a matrix form. In an exemplary embodiment, as shown in FIG. 10, each of the pixels 111 may include an organic light emitting element OLED including dielectrophoresis materials and an organic light emitting element driving circuit TC that drives the organic light emitting element OLED. As described above, in such an embodiment of the display device 100, the organic light emitting element OLED may emit different color lights (e.g., a red color light, a green color light and a blue color light or a white color light, a red color light, a green color light and a blue color light) corresponding to voltage ranges to which a driving voltage applied to the organic light emitting element belongs. Thus, the pixel 111 including the organic light emitting element OLED may implement different colors corresponding to the voltage ranges to which the driving voltage belongs. Generally, a conventional display device may include a display panel including red color pixels (i.e., pixels for outputting the red color light), green color pixels (i.e., pixels for outputting the green color light), and blue color pixels (i.e., pixels for outputting the blue color light) or may include a display panel including the red color pixels, the green color pixels, the blue color pixels, and white color pixels (i.e., pixels for outputting the white color light). In an exemplary embodiment, the display device 100 may include the display panel 120 including the pixels 111, each of which outputs the different color lights (e.g., the red color light, the green color light and the blue color light, or the white color light, the red color light, the green color light and the blue color light) corresponding to the voltage ranges to which the driving voltage applied to the pixel 111 belongs. Thus, in such an embodiment, the display device 100 may have resolution three or four times higher than that of the conventional display device under a same condition. In such an embodiment, the display device 100 may be manufactured with high resolution as compared to the conventional display device. In such an embodiment, one pixel 111 may define one unit pixel for implementing various colors in the display device 100, whereas the red color pixel, the green color pixel and the blue color pixel (or, the white color pixel, the red color pixel, the green color pixel and the blue color pixel) may define one unit pixel for implementing various colors in the conventional display device.

In an exemplary embodiment, as illustrated in FIG. 10, each of the pixels 111 may include a first transistor T1, a second transistor T2, a third transistor T3, a fourth transistor T4, a fifth transistor T5, a sixth transistor T6, a storage capacitor Cst and an organic light emitting element OLED. The first transistor T1 may be connected between a first node N1 and a third node N3. A gate terminal of the first transistor T1 may be connected to a second node N2. In such an embodiment, the first transistor T1 may be referred to as a driving transistor. The second transistor T2 may be connected between a data-line DSL and the first node N1. A gate terminal of the second transistor T2 may be connected to a scan-line SSL(m). In such an embodiment, the second transistor T2 may be referred to as a switching transistor. The third transistor T3 may be connected between the second node N2 and the third node N3. A gate terminal of the third transistor T3 may be connected to the scan-line SSL(m). The fourth transistor T4 may be connected between the third node N3 and an initialization voltage VINT. A gate terminal of the fourth transistor T4 may be connected to a previous scan-line SSL(m−1). The fifth transistor T5 may be connected between the first node N1 and a high power voltage ELVDD. A gate terminal of the fifth transistor T5 may be connected to an emission control-line EML(m). The sixth transistor T6 may be connected between the second node N2 and the organic light emitting element OLED. A gate terminal of the sixth transistor T6 may be connected to the emission control-line EML(m). In such an embodiment, the sixth transistor T6 may be referred to as an emission control transistor. The storage capacitor Cst may be connected between the high power voltage ELVDD and the third node N3. The organic light emitting element OLED may be connected between the sixth transistor T6 and a low power voltage ELVSS. The structure of the pixel 111 illustrated in FIG. 10 is merely exemplary, and the structure of the pixel 111 is not limited thereto.

In such an embodiment, the third node N3 may be initialized, for an operation of the pixel 111, when the fourth transistor T4 is turned on in response to a previous scan signal SS applied via a previous scan-line SSL(m−1). Subsequently, when the second transistor T2 and the third transistor T3 are turned on in response to a scan signal SS applied via the scan-line SSL(m) and when the fifth transistor T5 and the sixth transistor T6 are turned off in response to an emission control signal EM applied via the emission control-line EML(m), a data signal DS applied via the data-line DSL may be stored in the storage capacitor Cst. In such an embodiment, when the second transistor T2 and the third transistor T3 are turned off in response to the scan signal SS applied via the scan-line SSL(m) and when the fifth transistor T5 and the sixth transistor T6 are turned on in response to the emission control signal EM applied via the emission control-line EML(m), a specific driving voltage may be applied to the organic light emitting element OLED (i.e., a current may flow through the organic light emitting element OLED), and thus the organic light emitting element OLED may emit light. In such an embodiment, as described above, the operation of the pixel 111 may be performed in each of first through k-th sub-frames 1SF through kSF, where one image frame 1F is divided into the first through k-th sub-frames 1SF through kSF. In an exemplary embodiment, as shown in FIG. 10, the first through sixth transistors T1 through T6 are implemented by p-channel metal oxide semiconductor ("PMOS") transistors, but the first through sixth transistors T1 through T6 are not limited thereto. In one alternative exemplary embodiment, for example, the first through sixth transistors T1 through T6 are implemented by n-channel metal oxide semiconductor ("NMOS") transistors or by combination of the PMOS transistors and the NMOS transistors.

The display panel driving circuit 140 may drive the display panel 120. In an exemplary embodiment, the display panel driving circuit 140 may drive the display panel 120 in a field sequential driving technique by dividing one image frame 1F into the first through k-th sub-frames 1SF through kSF and by applying the first through k-th driving voltages to the pixels 111 in the first through k-th sub-frames 1SF through kSF, respectively. In such an embodiment, the display panel driving circuit 140 may include a scan driver, a data driver and a timing controller. In an exemplary embodiment, the display panel driving circuit 140 may further include an emission controller. In such an embodiment, the display panel 120 may be connected to the scan driver via the scan-lines SSL. In such an embodiment, the display panel 120 may be connected to the data driver via the data-lines DSL. In such an embodiment, the display panel 120 may be connected to the emission controller via the emission control-lines EML. The scan driver may provide the scan signal SS to the display panel 120 via the scan-lines SSL. The data driver may provide the data signal DS to the display panel 120 via the data-lines DSL. The emission controller may provide the emission control signal EM to the display panel 120 via the emission control-lines EML. The timing controller may control the scan driver, the data driver and the emission controller. The structure of the display panel driving circuit 140 described above is merely exemplary, and components of the display panel driving circuit 140 are not limited thereto. In an exemplary embodiment, the display panel driving circuit 140 may further include at least one frame memory to divide one image frame 1F into the first through k-th sub-frames 1SF through kSF.

In an exemplary embodiment, each of the pixels 111 included in the display panel 120 may output a red color light (i.e., may implement a red color) when a first driving voltage belonging to a first voltage range is applied to the pixel 111, may output a green color light (i.e., may implement a green color) when a second driving voltage belonging to a second voltage range is applied to the pixel 111, and may output a blue color light (i.e., may implement a blue color) when a third driving voltage belonging to a third voltage range is applied to the pixel 111. In such an embodiment, the display panel driving circuit 140 may divide one image frame 1F into the first through third sub-frames 1SF, 2SF, and 3SF, may output a red color image by applying the first driving voltage to the pixels 111 in the first sub-frame 1SF, may output a green color image by applying the second driving voltage to the pixels 111 in the second sub-frame 2SF, and may output a blue color image by applying the third driving voltage to the pixels 111 in the third sub-frame 3SF. In an exemplary embodiment, the display panel driving circuit 140 may output a black color image by applying a fourth driving voltage to the pixels 111 between the first sub-frame 1SF and the second sub-frame 2SF, may output the black color image by applying the fourth driving voltage to the pixels 111 between the second sub-frame 2SF and the third sub-frame 3SF, and may output the black color image by applying the fourth driving voltage to the pixels 111 between the third sub-frame 3SF and a next image frame. Since such an embodiment of a method of driving a display panel is substantially the same as those described above with reference to FIGS. 1 to 4B, and any repetitive detailed description thereof will be omitted.

In an alternative exemplary embodiment, each of the pixels 111 included in the display panel 120 may output a white color light (i.e., may implement a white color) when a first driving voltage belonging to a first voltage range is applied to the pixel 111, may output a red color light (i.e., may implement a red color) when a second driving voltage belonging to a second voltage range is applied to the pixel 111, may output a green color light (i.e., may implement a green color) when a third driving voltage belonging to a third voltage range is applied to the pixel 111, and may output a blue color light (i.e., may implement a blue color) when a fourth driving voltage belonging to a fourth voltage range is applied to the pixel 111. In this case, the display panel driving circuit 140 may divide one image frame 1F into the first through fourth sub-frames 1SF, 2SF, 3SF, and 4SF, may output a white color image by applying the first driving voltage to the pixels 111 in the first sub-frame 1SF, may output a red color image by applying the second driving voltage to the pixels 111 in the second sub-frame 2SF, may output a green color image by applying the third driving voltage to the pixels 111 in the third sub-frame 3SF, and may output a blue color image by applying the fourth driving voltage to the pixels 111 in the fourth sub-frame 4SF. In an exemplary embodiment, the display panel driving circuit 140 may output a black color image by applying a fifth driving voltage to the pixels 111 between the first sub-frame 1SF and the second sub-frame 2SF, may output the black color image by applying the fifth driving voltage to the pixels 111 between the second sub-frame 2SF and the third sub-frame 3SF, may output the black color image by applying the fifth driving voltage to the pixels 111 between the third sub-frame 3SF and the fourth sub-frame 4SF, and may output the black color image by applying the fifth driving voltage to the pixels 111 between the fourth sub-frame 4SF and a next image frame. Since such an embodiment of a method of driving a display panel is substantially the same as those described above described with reference to FIGS. 5 to 8B, and any repetitive detailed description thereof will be omitted.

In an exemplary embodiment, the display panel driving circuit 140 may receive image data DAT corresponding to the image frame 1F from an external component, may divide the image frame 1F into the first through k-th sub-frames 1SF through kSF, and may implement the image frame 1F by implementing the first through k-th sub-frames 1SF through kSF. In an exemplary embodiment, as illustrated in FIG. 11, the display panel driving circuit 140 may implement the image frame 1F at a frequency of n hertz (Hz) by receiving the image data DAT corresponding to the image frame 1F from the external component at a frequency of n Hz and by implementing each of the first through k-th sub-frames 1SF through kSF based on the image data DAT at a frequency of kxn Hz. In such an embodiment, the display panel driving circuit 140 may include a first frame memory for storing the image frame 1F that is received from the external component at a frequency of n Hz and a second frame memory for temporarily storing and outputting the first through k-th sub-frames 1SF through kSF. In one exemplary embodiment, for example, when each of the pixels 111 implements three colors (i.e., implements the red color when the first driving voltage belonging to the first voltage range is applied to the pixel 111, implements the green color when the second driving voltage belonging to the second voltage range is applied to the pixel 111, and implements the blue color when the third driving voltage belonging to the third voltage range is applied to the pixel 111), the display panel driving circuit 140 may implement the image frame 1F at a frequency of n Hz by receiving the image data DAT corresponding to the image frame 1F from the external component at a frequency ofn Hz and by implementing each of the first through third sub-frames 1SF, 2SF and 3SF based on the image data DAT at a frequency of 3×n Hz. In one exemplary embodiment, for example, when each of the pixels 111 implements four colors (i.e., implements the white color when the first driving voltage belonging to the first voltage range is applied to the pixel 111, implements the red color when the second driving voltage belonging to the second voltage range is applied to the pixel 111, implements the green color when the third driving voltage belonging to the third voltage range is applied to the pixel 111, and implements the blue color when the fourth driving voltage belonging to the fourth voltage range is applied to the pixel 111), the display panel driving circuit 140 may implement the image frame 1F at a frequency of n Hz by receiving the image data DAT corresponding to the image frame 1F from the external component at a frequency of n Hz and by implementing each of the first through fourth sub-frames 1SF, 2SF, 3SF and 4SF based on the image data DAT at a frequency of 4×n Hz.

In an alternative exemplary embodiment, as illustrated in FIG. 12, the display panel driving circuit 140 may implement an image frame 1F at a frequency of n Hz by receiving the image data DAT corresponding to each of the first through k-th sub-frames 1SF through kSF from the external component at a frequency of kxn Hz and by implementing each of the first through k-th sub-frames 1SF through kSF based on the image data DAT at a frequency of k×n Hz. In one exemplary embodiment, for example, when each of the pixels 111 implements three colors (e.g., implements the red color when the first driving voltage belonging to the first voltage range is applied to the pixel 111, implements the green color when the second driving voltage belonging to the second voltage range is applied to the pixel 111, and implements the blue color when the third driving voltage belonging to the third voltage range is applied to the pixel 111), the display panel driving circuit 140 may implement the image frame 1F at a frequency of n Hz by receiving the image data DAT corresponding to each of the first through third sub-frames 1SF, 2SF, and 3SF from the external component at a frequency of 3×n Hz and by implementing each of the first through third sub-frames 1SF, 2SF and 3SF based on the image data DAT at a frequency of 3×n Hz. In one exemplary embodiment, for example, when each of the pixels 111 implements four colors (e.g., implements the white color when the first driving voltage belonging to the first voltage range is applied to the pixel 111, implements the red color when the second driving voltage belonging to the second voltage range is applied to the pixel 111, implements the green color when the third driving voltage belonging to the third voltage range is applied to the pixel 111, and implements the blue color when the fourth driving voltage belonging to the fourth voltage range is applied to the pixel 111), the display panel driving circuit 140 may implement the image frame 1F at a frequency of n Hz by receiving the image data DAT corresponding to each of the first through fourth sub-frames 1SF, 2SF, 3SF and 4SF from the external component at a frequency of 4×n Hz and by implementing each of the first through fourth sub-frames 1SF, 2SF, 3SF and 4SF based on the image data DAT at a frequency of 4×n Hz. In an exemplary embodiment, as described above, the display device 100 may efficiently drive the display panel 120 including the pixels 111, each of which implements the different colors according to the voltage ranges to which the driving voltage applied to the pixel 111 belongs, in the field sequential driving technique. Thus, in such an embodiment, the display device 100 may display an image with high resolution as compared to a conventional display device.

Figure 13:
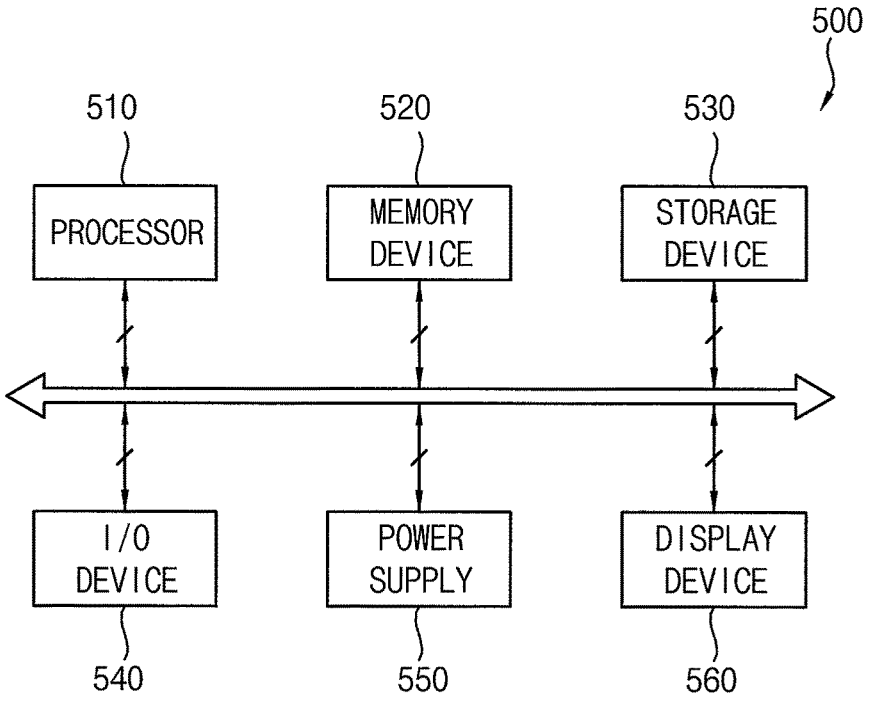
FIG. 13 is a block diagram illustrating an electronic device according to an exemplary embodiment.
Figure 14:
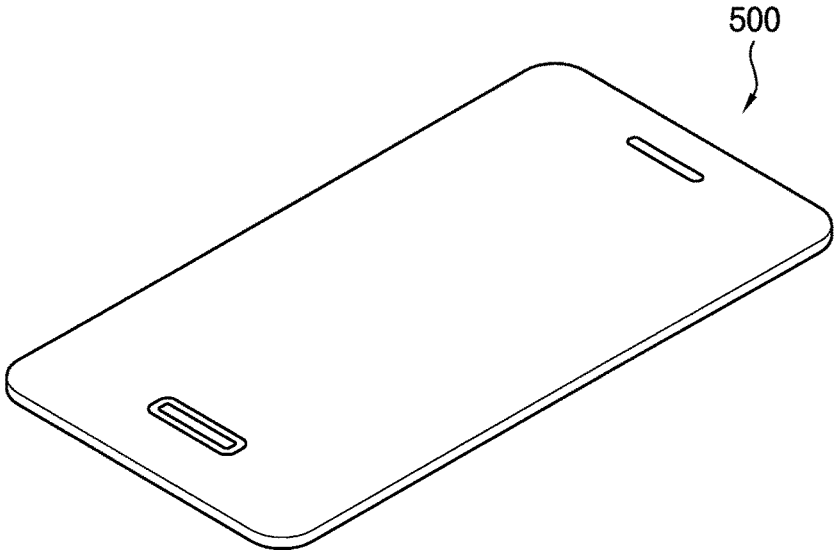
FIG. 14 is a diagram illustrating an exemplary embodiment of a smart phone in which the electronic device of FIG. 13 is implemented.
Figure 15:
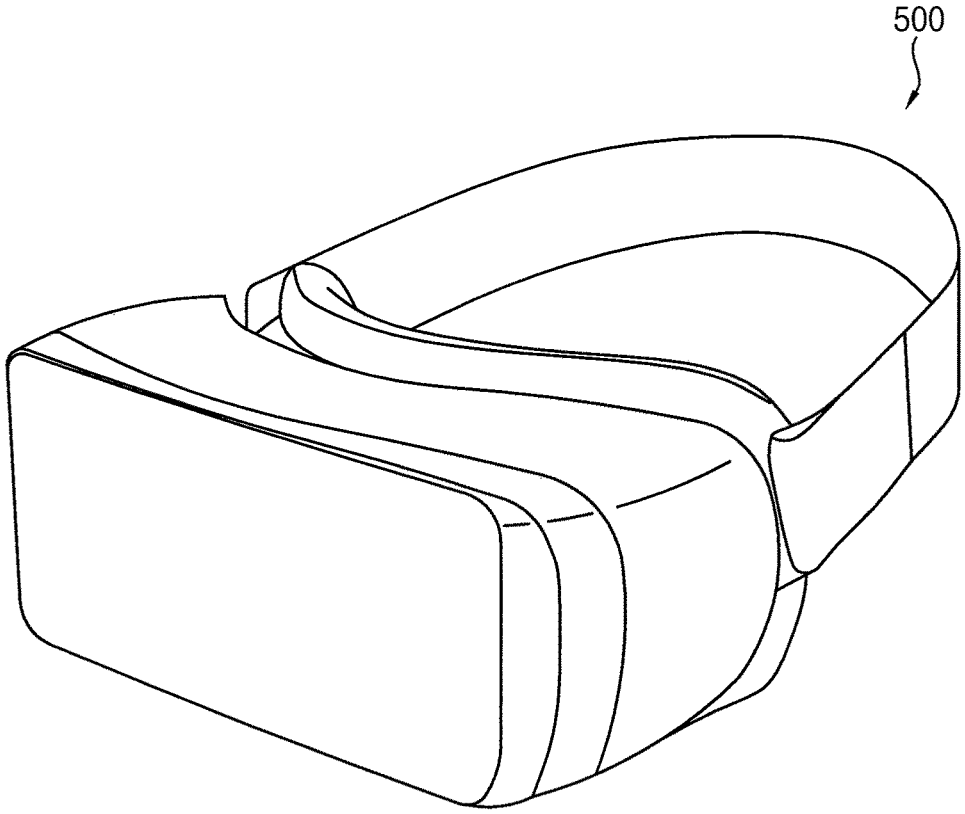
FIG. 15 is a diagram illustrating an exemplary embodiment of a head mounted display ("HMD") in the electronic device of FIG. 13 is implemented.

FIG. 13 is a block diagram illustrating an electronic device according to an exemplary embodiment, FIG. 14 is a diagram illustrating an example in which the electronic device of FIG. 13 is implemented as a smart phone, and FIG. 15 is a diagram illustrating an example in which the electronic device of FIG. 13 is implemented as a head mounted display.

Referring to FIGS. 13 to 15, an exemplary embodiment of the electronic device 500 may include a processor 510, a memory device 520, a storage device 530, an input/output ("O") device 540, a power supply 550 and a display device 560. In such an embodiment, the display device 560 may be the display device 100 of FIG. 9. The electronic device 500 may further include a plurality of ports for communicating with a video card, a sound card, a memory card, a universal serial bus ("USB") device, other electronic devices, etc. In an exemplary embodiment, as illustrated in FIG. 14, the electronic device 500 may be implemented as a smart phone. In an alternative exemplary embodiment, as illustrated in FIG. 15, the electronic device 500 may be implemented as a head mounted display. However, embodiments of the electronic device 500 are not limited thereto. In an exemplary embodiment, the electronic device 500 may be implemented as a cellular phone, a video phone, a smart pad, a smart watch, a tablet personal computer ("PC"), a car navigation system, a computer monitor, a laptop, a television, a digital camera, an MP3 player, for example.

The processor 510 may perform various computing functions. The processor 510 may be a microprocessor, a central processing unit ("CPU") or an application processor ("AP"), for example. The processor 510 may be coupled to other components via an address bus, a control bus, a data bus, etc. Further, the processor 510 may be coupled to an extended bus such as a peripheral component interconnection ("PCI") bus. The memory device 520 may store data for operations of the electronic device 500. In one exemplary embodiment, for example, the memory device 520 may include a non-volatile memory device, such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device and a ferroelectric random access memory ("FRAM") device, and/or a volatile memory device, such as a dynamic random access memory ("DRAM") device, a static random access memory ("SRAM") device, a mobile DRAM device, etc. The storage device 530 may include a solid state drive ("SSD") device, a hard disk drive ("HDD") device or a CD-ROM device, for example. The I/O device 540 may include an input device such as a keyboard, a keypad, a mouse device, a touchpad, a touch-screen, etc., and an output device such as a printer, a speaker, etc. In an exemplary embodiment, the display device 560 may be included in the I/O device 540. The power supply 550 may provide power for operations of the electronic device 500.

The display device 560 may be coupled to other components via the buses or other communication links. In an exemplary embodiment, the display device 560 may be an organic light emitting display device, and each of the pixels included in a display panel of the display device 560 may include an organic light emitting element including dielectrophoresis materials. In such an embodiment, as described above, the display device 560 may efficiently drive the display panel including the pixels, each of which outputs different color lights corresponding to voltage ranges to which a driving voltage belongs in a field sequential driving technique. Thus, the display device 560 may be manufactured with high resolution as compared to a conventional display device. In such an embodiment, the display device 560 may include the display panel and a display panel driving circuit. The display panel may include the pixels, each of which outputs first through k-th color lights in response to first through k-th driving voltages, where the first through k-th driving voltages belong to first through k-th voltage ranges, respectively. The display panel driving circuit may drive the display panel using the field sequential driving technique that divides one image frame into first through k-th sub-frames and applies the first through k-th driving voltages to the pixels in the first through k-th sub-frames, respectively. In an exemplary embodiment, the display panel driving circuit may implement an image frame at a frequency of n Hz by receiving image data corresponding to the image frame from an external component at a frequency of n Hz and by implementing each of the first through k-th sub-frames, where the image frame is divided into the first through k-th sub-frames, based on the image data at a frequency of kxn Hz. In another example embodiment, the display panel driving circuit may implement an image frame at a frequency of n Hz by receiving image data corresponding to each of the first through k-th sub-frames, where the image frame is divided into the first through k-th sub-frames, from an external component at a frequency of kxn Hz and by implementing each of the first through k-th sub-frames based on the image data at a frequency of kxn Hz. Since such an embodiment of the display device 560 is substantially the same as those described above, any repetitive detailed description thereof will be omitted.

Exemplary embodiments of the invention may be applied to an electronic device including a display device. Exemplary embodiments of the invention may be applied to a cellular phone, a smart phone, a video phone, a head mounted display, a television, a computer monitor, a laptop, a digital camera, a smart pad, a smart watch, a tablet PC, an MP3 player or a car navigation system, for example.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A method of driving a display panel including a plurality of pixels, each of which outputs different color lights corresponding to voltage ranges to which a driving voltage applied thereto belongs, the method comprising, for an image frame divided into first through third sub-frames:

outputting a first color image displayed by a first color by applying a first driving voltage belonging to a first voltage range to the pixels in the first sub-frame;

outputting a second color image displayed by a second color by applying a second driving voltage belonging to a second voltage range to the pixels in the second sub-frame; and outputting a third color image displayed by a third color by applying a third driving voltage belonging to a third voltage range to the pixels in the third sub-frame, wherein each of the pixels includes a light emitting structure electrically connected between one first power voltage and one second power voltage, the light emitting structure emits light of the first color in response to when any voltage in the first voltage range is applied thereto, emits light of the second color in response to when any voltage in the second voltage range is applied thereto, and emits light of the third color in response to when any voltage in the third voltage range is applied thereto, and the first voltage range, the second voltage range and the third voltage range do not overlap each other.

2. The method of claim 1, wherein the light emitting structure includes dielectrophoresis materials.

3. The method of claim 2, wherein the first color image is a red color image, the second color image is a green color image, and the third color image is a blue color image.

4. The method of claim 1, further comprising:

outputting a black color image by applying a fourth driving voltage to the pixels between the first sub-frame and the second sub-frame;

outputting the black color image by applying the fourth driving voltage to the pixels between the second sub-frame and the third sub-frame; and outputting the black color image by applying the fourth driving voltage to the pixels between the third sub-frame and a next image frame.

5. The method of claim 4, wherein the first voltage range is lower than the second voltage range, the second voltage range is lower than the third voltage range, and the third voltage range is lower than the fourth driving voltage.

6. The method of claim 1, wherein the first driving voltage, the second driving voltage, and the third driving voltage are supplied to the light emitting structure via a single line.

7. The method of claim 1, wherein all of the light emitting is structures are commonly electrically connected between only one first power voltage and only one second power voltage.

8. A method of driving a display panel including a plurality of pixels, each of which outputs different color lights corresponding to voltage ranges to which a driving voltage applied to the pixel belongs, the method comprising, for an image frame divided into first through fourth sub-frames:

outputting a first color image displayed by a first color by applying a first driving voltage belonging to a first voltage range to the pixels only in the first sub-frame;

outputting a second color image displayed by a second color by applying a second driving voltage belonging to a second voltage range to the pixels only in the second sub-frame;

outputting a third color image displayed by a third color by applying a third driving voltage belonging to a third voltage range to the pixels only in the third sub-frame; and outputting a fourth color image displayed by a fourth color by applying a fourth driving voltage belonging to a fourth voltage range to the pixels only in the fourth sub-frame, wherein each of the pixels includes a light emitting structure electrically connected between one first power voltage and one second power voltage, the light emitting structure emits light of the first color in response to when any voltage in the first voltage range is applied thereto, emits light of the second color in response to when any voltage in the second voltage range is applied thereto, and emits light of the third color in response to when any voltage in the third voltage range is applied thereto, and the first voltage range, the second voltage range, the third voltage range and the fourth voltage range do not overlap each other.

9. The method of claim 8, wherein the light emitting structure includes dielectrophoresis materials.

10. The method of claim 9, wherein the first color image is a white color image, the second color image is a red color image, the third color image is a green color image, and the fourth color image is a blue color image.

11. The method of claim 8, further comprising:

outputting a black color image by applying a fifth driving voltage to the pixels between the first sub-frame and the second sub-frame;

outputting the black color image by applying the fifth driving voltage to the pixels between the second sub-frame and the third sub-frame;

outputting the black color image by applying the fifth driving voltage to the pixels between the third sub-frame and the fourth sub-frame; and outputting the black color image by applying the fifth driving voltage to the pixels between the fourth sub-frame and a next image frame.

12. The method of claim 11, wherein the first voltage range is lower than the second voltage range, the second voltage range is lower than the third voltage range, the third voltage range is lower than the fourth voltage range, and the fourth voltage range is lower than the fifth driving voltage.

13. The method of claim 8, wherein the first driving voltage, the second driving voltage, and the third driving voltage are supplied to the light emitting structure via a single line.

14. The method of claim 8, wherein all of the light emitting is structures are commonly electrically connected between only one first power voltage and only one second power voltage.

15. A display device, comprising:

a display panel including a plurality of pixels, each of which outputs first through k-th color lights in response to first through k-th driving voltages, respectively, wherein k is an integer greater than or equal to 3, and the first through k-th driving voltages belong to first through k-th voltage ranges, respectively; and a display panel driving circuit which drives the display panel in a field sequential driving technique by dividing one image frame into first through k-th sub-frames and by applying the first through k-th driving voltages to the pixels in the first through k-th sub-frames, respectively, wherein each of the pixels includes a light emitting structure electrically connected between one first power voltage and one second power voltage, the light emitting structure emits light of the first color in response to when any voltage in the first voltage range is applied thereto, emits light of the second color in response to when any voltage in the second voltage range is applied thereto, and emits light of the third color in response to when any voltage in the third voltage range is applied thereto, and the first through k-th driving voltage ranges do not overlap each other.

16. The device of claim 15, wherein the light emitting structure includes dielectrophoresis materials.

17. The device of claim 15, wherein each of the pixels outputs a red color light when a first driving voltage belonging to the first voltage range is applied thereto, each of the pixels outputs a green color light when a second driving voltage belonging to the second voltage range is applied thereto, each of the pixels outputs a blue color light when a third driving voltage belonging to the third voltage range is applied thereto, and the display panel driving circuit divides the image frame into the first through third sub-frames, outputs a red color image by applying the first driving voltage to the pixels in the first sub-frame, outputs a green color image by applying the second driving voltage to the pixels in the second sub-frame, and outputs a blue color image by applying the third driving voltage to the pixels in the third sub-frame.

18. The device of claim 17, wherein the display panel driving circuit:

outputs a black color image by applying a fourth driving voltage to the pixels between the first sub-frame and the second sub-frame, outputs the black color image by applying the fourth driving voltage to the pixels between the second sub-frame and the third sub-frame.

19. The device of claim 17, wherein the display panel driving circuit implements image frames at a frequency of n Hz by receiving image data corresponding to the image frames from an external component at the frequency of n Hz and by implementing each of the first through third sub-frames based on the image data at a frequency of 3×n Hz, wherein n is an integer greater than or equal to 2.

20. The device of claim 17, wherein the display panel driving circuit implements image frames at a frequency of n Hz, by receiving image data corresponding to each of the first through third sub-frames from an external component at a frequency of 3×n Hz and by implementing each of the first through third sub-frames based on the image data at the frequency of 3×n Hz, wherein n is an integer greater than or equal to 2.

21. The device of claim 15, wherein each of the pixels outputs a white color light when the first driving voltage belonging to the first voltage range is applied thereto, each of the pixels outputs a red color light when the second driving voltage belonging to the second voltage range is applied thereto, each of the pixels outputs a green color light when the third driving voltage belonging to the third voltage range is applied thereto, each of the pixels outputs a blue color light when the fourth driving voltage belonging to the fourth voltage range is applied thereto, and the display panel driving circuit divides the image frame into the first through fourth sub-frames, outputs a white color image by applying the first driving voltage to the pixels in the first sub-frame, outputs a red color image by applying the second driving voltage to the pixels in the second sub-frame, outputs a green color image by applying the third driving voltage to the pixels in the third sub-frame, and outputs a blue color image by applying the fourth driving voltage to the pixels in the fourth sub-frame.

22. The device of claim 21, wherein the display panel driving circuit:

outputs a black color image by applying a fifth driving voltage to the pixels between the first sub-frame and the second sub-frame, outputs the black color image by applying the fifth driving voltage to the pixels between the second sub-frame and the third sub-frame, outputs the black color image by applying the fifth driving voltage to the pixels between the third sub-frame and the fourth sub-frame, and outputs the black color image by applying the fifth driving voltage to the pixels between the fourth sub-frame and a next image frame.

23. The device of claim 15, wherein the display panel driving circuit implements the image frame at a frequency of n Hz by receiving image data corresponding to the image frame from an external component at the frequency of n Hz and by implementing each of the first through fourth sub-frames based on the image data at a frequency of 4×n Hz, wherein n is an integer greater than or equal to 2.

24. The device of claim 21, wherein the display panel driving circuit implements image frames at a frequency of n Hz by receiving image data corresponding to each of the first through fourth sub-frames from an external component at a frequency of 4×n Hz and by implementing each of the first through fourth sub-frames based on the image data at the frequency of 4×n Hz, wherein n is an integer greater than or equal to 2.

25. The device of claim 15, wherein:

each of the pixels outputs a first color light when a first driving voltage belonging to the first voltage range is applied thereto, each of the pixels outputs a second color light when a second driving voltage belonging to the second voltage range is applied thereto, and each of the pixels outputs a third color light when a third driving voltage belonging to the third voltage range is applied thereto.

26. The device of claim 25, wherein the first driving voltage, the second driving voltage, and the third driving voltage are supplied to the light emitting structure via a single line.

27. The method of claim 15, wherein all of the light emitting is structures are commonly electrically connected between only one first power voltage and only one second power voltage.

* * * * *